US009402434B2

(12) United States Patent
Isobe

(10) Patent No.: US 9,402,434 B2
(45) Date of Patent: Aug. 2, 2016

(54) HELMET SHIELD ATTACHING MECHANISM

(71) Applicant: SHOEI CO., LTD., Tokyo (JP)

(72) Inventor: Eiji Isobe, Chiba (JP)

(73) Assignee: SHOEI CO., LTD., Tokyo (JP)

( * ) Notice: Subject to any disclaimer, the term of this patent is extended or adjusted under 35 U.S.C. 154(b) by 128 days.

(21) Appl. No.: 14/248,804

(22) Filed: Apr. 9, 2014

(65) Prior Publication Data

US 2014/0352020 A1 Dec. 4, 2014

(30) Foreign Application Priority Data

Jun. 3, 2013 (JP) ..... 2013-116710

(51) Int. Cl.
*A42B 1/08* (2006.01)
*A42B 3/22* (2006.01)

(52) U.S. Cl.
CPC ..... *A42B 3/223* (2013.01)

(58) Field of Classification Search
CPC ..... A42B 3/222; A42B 3/22; A42B 3/221; A42B 3/228; A42B 3/24
See application file for complete search history.

(56) References Cited

U.S. PATENT DOCUMENTS 5,765,235 A * 6/1998 Arnold ..... A42B 3/24 2/15
7,398,561 B2 * 7/2008 Kim ..... A42B 3/326 2/424

FOREIGN PATENT DOCUMENTS

EP 1 293 138 A1 3/2003
EP 1 856 999 A2 11/2007

* cited by examiner

*Primary Examiner* — Anna Kinsaul
(74) *Attorney, Agent, or Firm* — Hunton & Williams LLP

(57) ABSTRACT

This invention provides a helmet shield attaching mechanism capable of relatively easily and relatively accurately performing an adjustment operation for satisfactorily bringing the inner surface of a shield in a substantially fully-closed state into close contact with the window opening rim portion of a head protecting body. The holding position of stopped means of a movable base member, whose position is held by stopper means of a stationary base member in an at least substantially fully-closed state of the shield, can be selected from one of a plurality of portions of the movable base member substantially in the back-and-forth direction.

12 Claims, 20 Drawing Sheets

34
35
21
13
26a
22a
23a
33a
15
31a
32a
28a
26b
37
36
39
38a
38
38b
27a
23b
33b
22b
32b
28b
41
42
27b
31b
58
57
56
C1
14
55
54
50a
52a
52b
51a
73
68
76
77
67
136
65
53a
79
53b
51b
50b
91
81
16
96
83
95
84
85
75
93
94
92
17
4
125
121
124
C2
131
126
127
132
123
129
122
133
128

HELMET SHIELD ATTACHING MECHANISM

CROSS-REFERENCE TO RELATED APPLICATIONS

This application claims priority to JP 2013-116710, filed Jun. 3, 2013, the disclosure of which is hereby incorporated by reference in its entirety.

TECHNICAL FIELD

The present invention relates to a helmet shield attaching mechanism comprising a shield attaching base member attaching to a head protecting body, and a shield whose region including one of a left end and a right end and a vicinity thereof rotatably attaches to the shield attaching base member, the shield attaching base member comprising a stationary base member attaching to the head protecting body, and a movable base member attaching to the stationary base member so as to be movable forward and backward substantially in the back-and-forth direction with respect to the stationary base member, and the shield being substantially rotatably supportable by the movable base member.

BACKGROUND OF THE INVENTION

A full-face-type helmet including a pair of left and right shield attaching mechanisms having the above-described arrangement is disclosed in EP 1 856 999 A2. In the shield attaching mechanism of EP 1 856 999 A2, a cam face is provided on the shield, and a cam follower portion is provided on the stationary base member so as to be able to abut against the cam face. In addition, when a force in a substantially rising direction is applied to the shield in a fully-closed state, the cam follower portion relatively follows the cam face, and the shield can thus move forward substantially to a front side together with the movable base member.

Hence, according to the shield attaching mechanism of EP 1 856 999 A2, the shield can rise without being caught by the window opening rim member of the head protecting body or the like. Additionally, although the shield attaching mechanism has a relatively simple structure, the shield can be pulled forward and then raised only by performing an operation of pulling the shield in the fully-closed state upward. For this reason, the operation of pulling the shield in the fully-closed state upward is relatively easy and relatively reliable, and no operation error occurs substantially.

In the shield attaching mechanism of EP 1 856 999 A2, however, it is cumbersome to do an adjustment operation so as to satisfactorily bring the inner surface of the shield into close contact with the window opening rim member attaching to the window opening of the head protecting body in the fully-closed state of the shield. More specifically, in this adjustment operation, it is necessary to remove the shield from the shield attaching mechanisms in advance, loosen two male screw members that attach the stationary base member to the head protecting body, and then adjust the attachment position of the stationary base member with respect to the head protecting body in the back-and-forth direction. It is relatively difficult to satisfactorily bring the inner surface of the shield into close contact with the window opening rim member only by performing the adjustment operation once.

SUMMARY OF THE INVENTION

The present invention is aimed at effectively correcting the above drawbacks of the helmet shield attaching mechanism disclosed in EP 1 856 999 A2 with a relatively simple arrangement.

According to the present invention, there is provided a helmet shield attaching mechanism comprising a shield attaching base member attaching to a head protecting body, and a shield whose region including one of a left end and a right end and a vicinity thereof rotatably attaches to the shield attaching base member, the shield attaching base member comprising a stationary base member attaching to the head protecting body, and a movable base member attaching to the stationary base member so as to be movable forward and backward substantially in a back-and-forth direction with respect to the stationary base member, and the shield being substantially rotatably supportable by the movable base member, wherein the stationary base member comprises stopper means, the movable base member comprises stopped means whose position can be held by the stopper means in an at least substantially fully-closed state of the shield, and when a holding position of the stopped means whose position is held by the stopper means in the at least substantially fully-closed state of the shield is selected from one of a plurality of portions of the movable base member substantially in the back-and-forth direction, the holding position substantially in the back-and-forth direction of the shield with respect to the head protecting body in the at least substantially fully-closed state can be selected. With this arrangement, an adjustment operation for satisfactorily bringing the inner surface of the shield in the substantially fully-closed state into close contact with the window opening rim portion of the head protecting body is relatively easy. In addition, the adjustment operation can be performed relatively accurately.

In the present invention, the movable base member can be configured to be substantially linearly movable forward and backward substantially in the back-and-forth direction with respect to the stationary base member. With this arrangement, an operation of moving the shield upward and downward can be performed relatively easily and relatively reliably.

In the present invention, the mechanism can further comprise elastic biasing means capable of elastically biasing the movable base member substantially backward to the stationary base member, and in the at least substantially fully-closed state, the stationary base member may be configured to elastically biased by the elastic biasing means and held at a backward moving position so as to make the stopped means abut against the stopper means. With this arrangement, the movable base member can relatively reliably be held at the backward moving position with respect to the stationary base member by a relatively simple structure. In this case, the stopped means preferably comprises a plurality of stopped means. The number of stopped means is more preferably 3 to 7 and most preferably 4 to 6.

In the present invention, the mechanism can further comprise a shield position adjustment pivotal manipulation member attaching to one of the movable base member and the stationary base member so as to be able to rotate, rotation preventing means provided on the one of the movable base member and the stationary base member, and back-and-forth positioning means provided on the other of the movable base member and the stationary base member, the pivotal manipulation member comprising a plurality of first recess/projection engaging means configured to selectively engage with the back-and-forth positioning means, and a plurality of second recess/projection engaging means configured to selectively engage with the rotation preventing means, wherein when the back-and-forth positioning means selectively engages with one of the plurality of first recess/projection engaging means, the holding position substantially in the back-and-forth direction of the shield can be selected, and when the rotation preventing means selectively engages with one of the plurality of second recess/projection engaging means, unwanted pivot of the pivotal manipulation member can be prevented. With this arrangement, the adjustment operation can be performed more accurately by a simpler structure. In this case, the number of the plurality of second recess/projection engaging means is preferably 3 to 7, and more preferably 4 to 6.

In the present invention, positions of the stopped means can be held by the stopper means only in the substantially fully-closed state and a substantially fully-open state of the shield. With this arrangement, an operation of setting the shield at the intermediate state between the substantially fully-closed state and the substantially fully-open state can be performed relatively easily. Hence, the mechanism for opening/closing the shield can have a relatively simple structure.

In the present invention, the shield can comprise a finger rest provided in a region including a lower end and a vicinity thereof of at least one of a left portion and a right portion of the shield, the finger rest being inclined downward substantially from a rear side substantially to a front side. With this arrangement, a force for moving the finger rest substantially forward is applied to the finger rest only by adding a force for substantially raising the shield to the finger rest. Hence, the operation of raising the shield is relatively easily.

In the present invention, a cam face is provided on one of the stationary base member and the shield, a cam follower portion is provided on the other of the stationary base member and the shield, and when a force that substantially raises the shield in the substantially fully-closed state is applied to the shield, the cam follower portion relatively follows the cam face so that the shield can also move substantially forward. With this arrangement, the shield can be pulled forward and then raised only by performing an operation of pulling the shield in the fully-closed state upward. For this reason, the operation of pulling the shield in the fully-closed state upward is relatively easy, and the shield can relatively reliably be moved upward and downward. In this case, the cam face can comprise a stopper recess configured to hold the shield at a substantially fully-closed position, an inclined surface configured to move the shield substantially forward, and a click tooth portion configured to hold the shield stepwise. With this arrangement, the operation of moving the shield in the fully-closed state upward is further reliable, and the operation of moving the shield downward is also reliable.

In the present invention, a shield attaching/removing manipulation member manipulated to remove the shield from the movable base member can be disposed on the movable base member so as to be movable forward and backward, and when the shield is rotated forward to the substantially fully-open state, and thereafter, the shield attaching/removing manipulation member is moved forward, a removable state of the shield can be obtained. With this arrangement, the shield removing operation can be performed relatively easily and relatively reliably.

The above, and other, objects, features and advantages of the present invention will become readily apparent from the following detailed description thereof which is to be read in connection with the accompanying drawings.

DETAILED DESCRIPTION OF THE INVENTION

An embodiment in which the present invention is applied to a shield attaching mechanism for a full-face-type helmet will be described in "1. Schematic Arrangement of Helmet as a Whole", "2. Arrangement of Shield Attaching Mechanism" and "3. Operation of Shield Attaching Mechanism" with reference to FIGS. 1 to 20.

1. Schematic Arrangement of Helmet as a Whole

Figure 1:
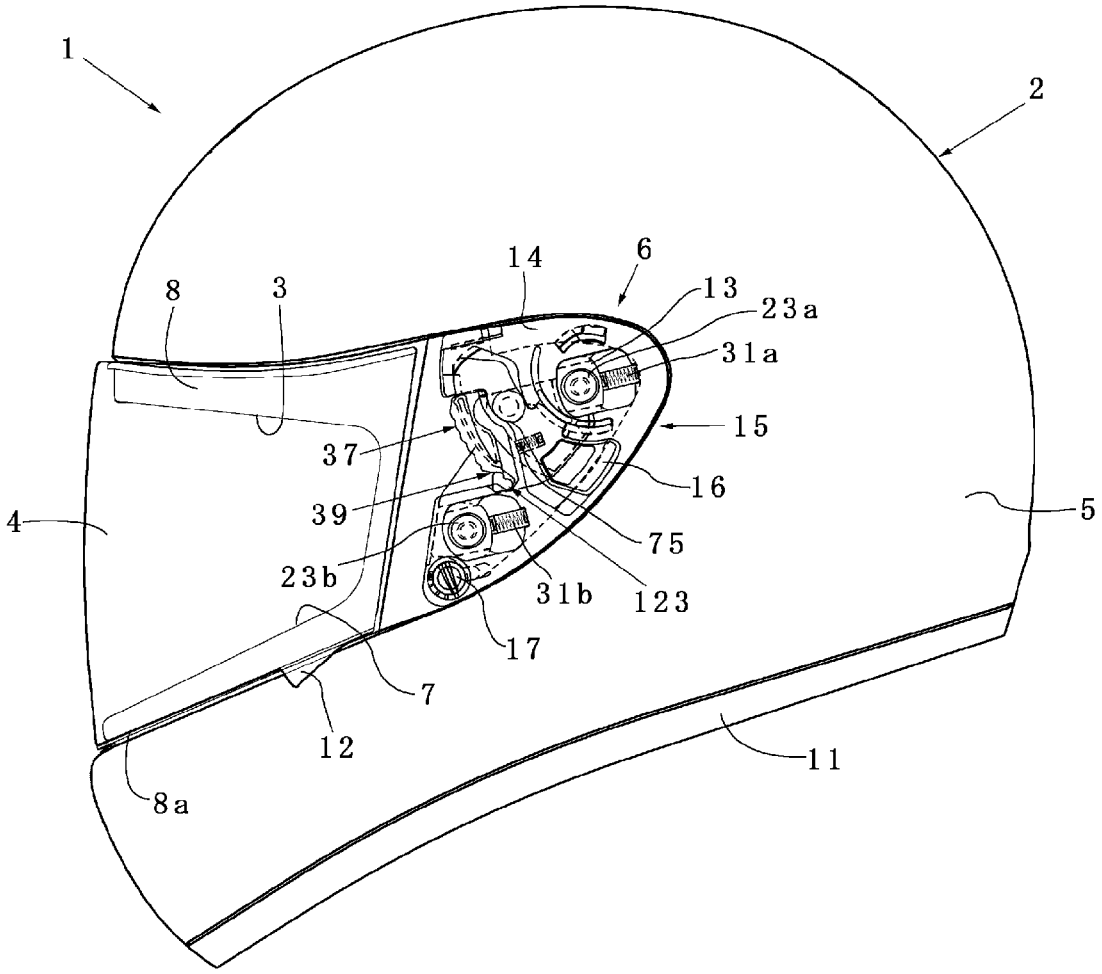
FIG. 1 is a schematic left side view of a helmet as a whole, in which a shield is in a fully-closed state, according to an embodiment in which the present invention is applied to a full-face-type helmet shield attaching mechanism.

As shown in FIG. 1, a full-face-type helmet 1 comprises a full-face-type head protecting body 2 to be worn on the head of a helmet wearer such as a motorcycle rider, a shield 4 which can open/close a window opening 3 formed in the front surface of the head protecting body 2 so as to oppose a portion between the forehead and chin (that is, the central portion of the face) of the helmet wearer, and a pair of left and right chin straps (not shown) attaching to the inner side of the head protecting body 2. Of the head protecting body 2, each of those portions which oppose the chin, forehead and the like of the helmet wearer is provided with one or a plurality of ventilators (not shown), where necessary, to ventilate air in the head protecting body 2. The shield 4 is provided to the helmet 1 to serve as a windshield. Where necessary, the shield 4 may be colored not to particularly interfere with the translucence so it can also serve as a sun visor (that is, a visor). The shield 4 can be made of a transparent or translucent hard material such as polycarbonate or another synthetic resin. A pair of left and right shield attaching mechanisms 6 pivotally attaches regions including the left and right side portions and vicinities thereof of the shield 4 to an outer shell 5 which constitutes the outer wall of the head protecting body 2.

Figure 2:
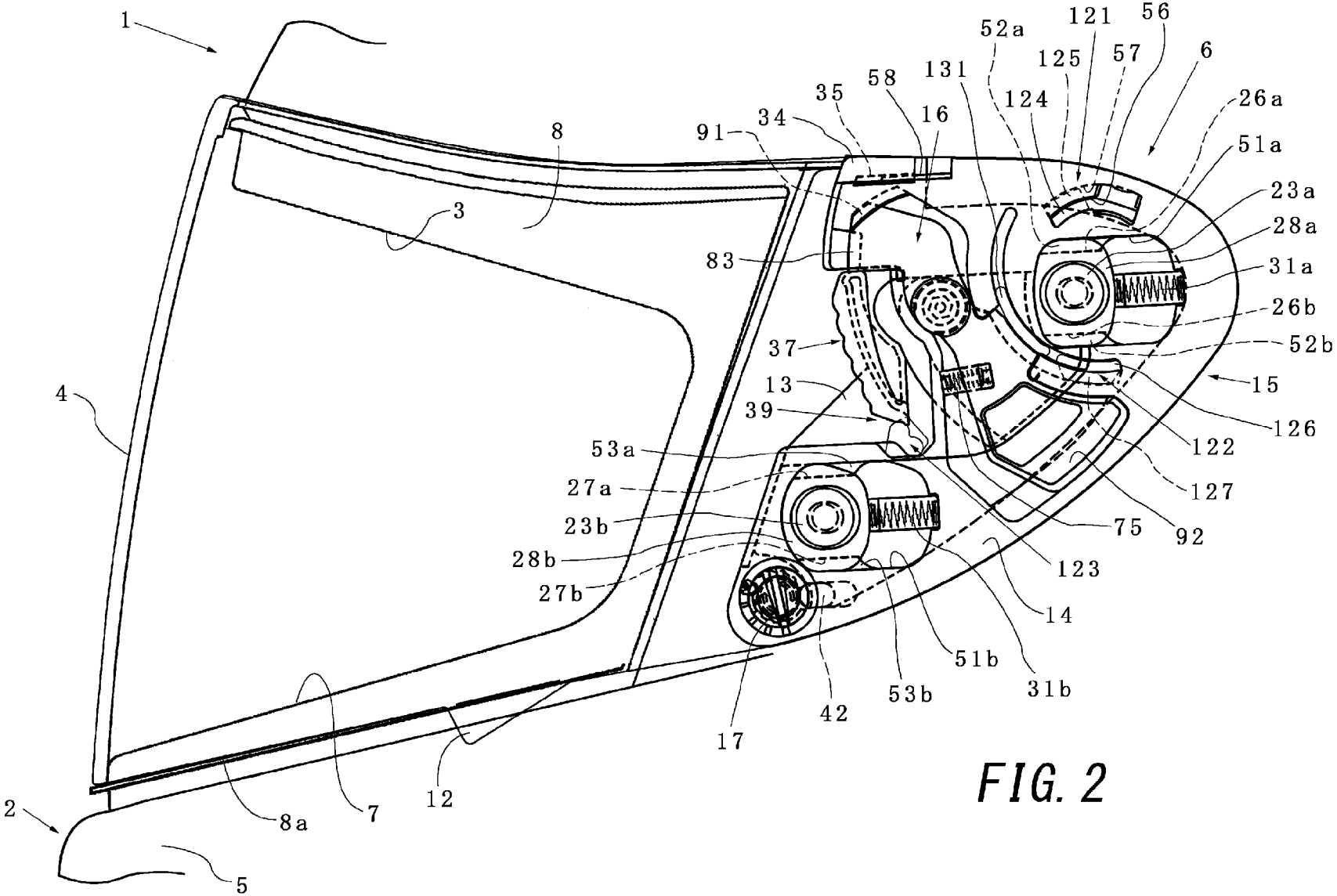
FIG. 2 is an enlarged left side view of the main part of the helmet to show the shield attaching mechanism in FIG. 1.

An anti-fogging auxiliary shield (not shown) which can be made of a transparent or translucent hard material such as polycarbonate or another synthetic resin can removably attach to the inner surface of the shield 4 shown in FIGS. 1 and 2 to form a small gap with the shield 4. To attach the anti-fogging auxiliary shield, a pair of left and right engaging pins (not shown) respectively having engaging ring-like grooves can attach and fix to those portions of the left and right sides of the inner surface of the shield 4, which are slightly below the central portions, by screwing or the like. A pair of left and right tongue pieces can project from those portions of the left and right ends of the anti-fogging auxiliary shield which are slightly below the central portions in a substantially vertical direction. The pair of left and right tongue pieces can respectively have a pair of left and right engaging slits which are open backwardly. The pair of left and right engaging pins can respectively fit in the pair of left and right engaging slits to attach the anti-fogging auxiliary shield to the inner surface of the shield 4. A packing projecting ridge (not shown) made of an elastic material such as silicone rubber can form a loop along the outer periphery of a region of the outer surface of the anti-fogging auxiliary shield except for the pair of left and right tongue pieces so that the anti-fogging auxiliary shield holds the small gap with the shield 4, and holds the gap airtightly.

Figure 11:
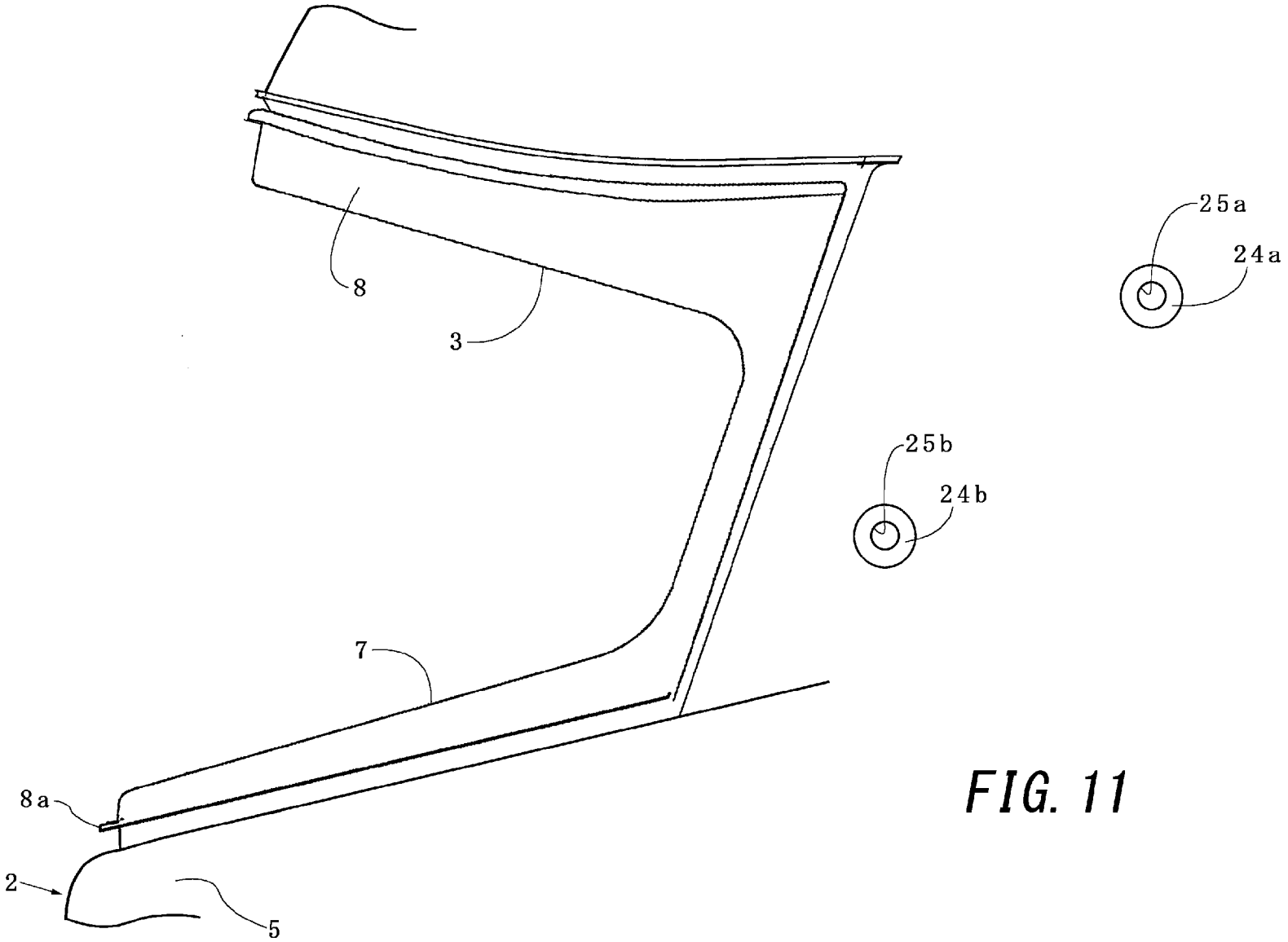
FIG. 11 is an enlarged left side view, similar to FIG. 2, of the helmet before the shield attaching mechanism is built into the head protecting body.

As is conventionally known, the outer shell 5 can be made of a strong hard material such as FRP or another synthetic resin. As shown in FIG. 1, a window opening rim member 8 having a substantially U- or E-shaped section attaches to substantially the entire periphery of a window opening 7, which is formed in the outer shell 5 to form the window opening 3 of the full-face-type head protecting body 2, by, for example, adhesion with an adhesive, double-sided adhesive tape, or the like, as has been conventionally known. As shown in FIGS. 1 and 11, the lower end of the shield 4 which is fully closed abuts against a projecting ridge 8*a* which substantially horizontally continues at the lower end of the window opening rim member 8 along the lower end of the window opening 7. A lower end rim member 11 having a substantially U-shaped section or the like attaches to substantially the entire periphery of the lower end of the outer shell 5 by, for example, adhesion with an adhesive or double-sided adhesive tape, or the like. As is conventionally known, the window opening rim member 8 can be made of synthetic rubber or another flexible elastic material. As is conventionally known, the lower end rim member 11 can be made of a soft material such as foamed vinyl chloride, synthetic rubber, or another soft synthetic resin. In FIG. 1, reference numeral 12 denotes a finger rest which is integrally provided to the lower end of the left portion of the shield 4. The helmet wearer places his fingers on the finger rest 12 when reciprocally pivoting the shield 4 upward and downward. Note that the finger rest 12 is gradually inclined downward substantially from the rear side substantially to the front side. For this reason, when the helmet wearer or the like presses the finger rest 12 substantially upward by his finger, the press force generates a component of force oriented forward. Hence, both a first force oriented substantially upward and a second force oriented substantially forward are applied to the shield 4.

The right (the left side to the front surface of the helmet) shield attaching mechanism 6 is axi-symmetrical with the left shield attaching mechanism 6. Hence, in the following description, a description on the right shield attaching mechanism 6 will not be repeated, and only the left shield attaching mechanism 6 will be described.

2. Arrangement of Shield Attaching Mechanism

Figure 9:
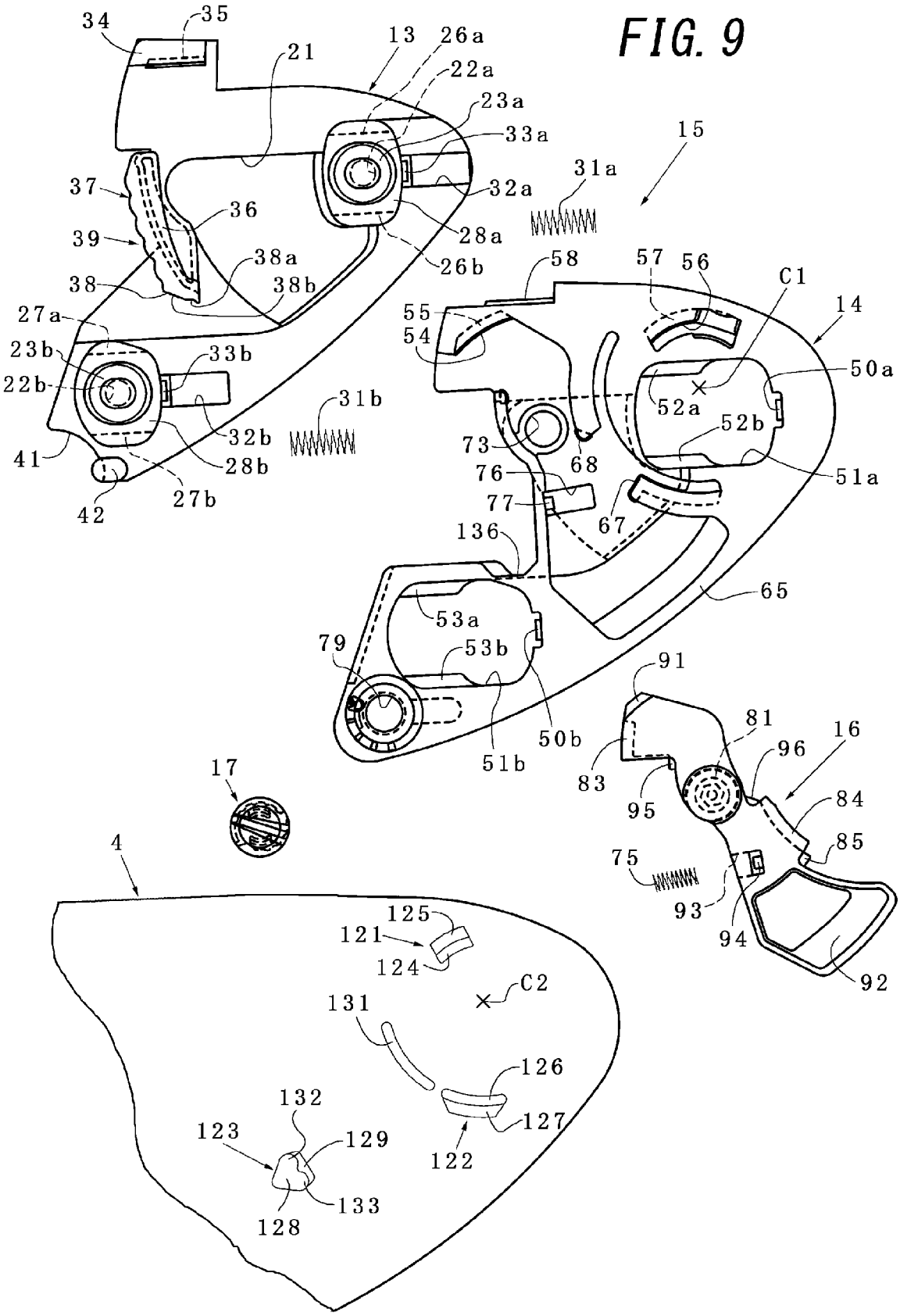
FIG. 9 is an exploded front view of the shield attaching mechanism in FIG. 1.

As shown in FIG. 9, the left shield attaching mechanism 6 can include members described in the following items (a) to (d):

(a) a shield attaching base member 15 which includes a stationary base member 13 and movable base member 14 and is used to attach the shield 4 to the head protecting body 2;

(b) a shield attaching/removing manipulation lever 16 which is manipulated when removing the shield 4 from the movable base member 14 and, in some cases, when attaching the shield 4 to the movable base member 14;

(c) a shield position adjustment pivotal manipulation button 17 (in other words, a pivotal manipulation member such as a pivotal manipulation rotor or pivotal manipulation selector serving as a shield position adjustment operation member) which can have a substantially flat cylindrical shape or substantially button shape and is manipulated when finely adjusting the fully-closed position of the shield 4 substantially in the back-and-forth direction; and (d) the shield 4 whose region including the left end and a vicinity thereof can removably attach to the movable base member 14.

Hence, the arrangement of the left shield attaching mechanism 6 will be described below in "(1) stationary base member", "(2) movable base member", "(3) shield attaching/removing manipulation lever", "(4) pivotal manipulation button", "(5) shield" and "(6) assembly of shield attaching mechanism" with reference to FIGS. 1 to 20. Note that each of the stationary base member 13, movable base member 14, shield attaching/removing manipulation lever 16 and pivotal manipulation button 17 can be made of an appropriate material, for example, a synthetic resin such as a polyacetal resin.

(1) Stationary Base Member

Figure 12:
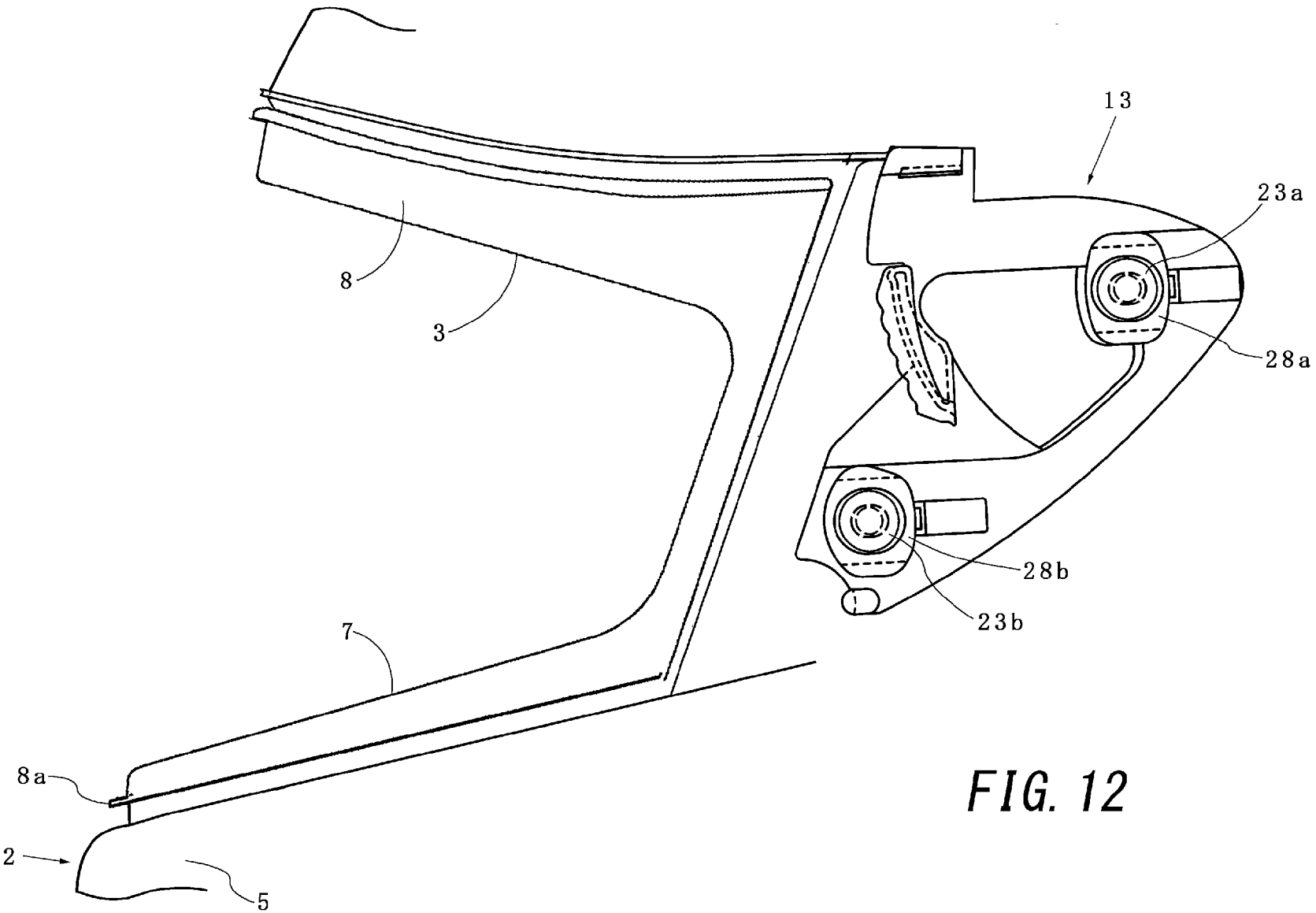
FIG. 12 is an enlarged left side view, similar to FIG. 11, of the helmet with the stationary base member of the shield attaching mechanism being built into the head protecting body.

As shown in FIGS. 9 and 12, the stationary base member 13 of the shield attaching base member 15 forms an approximately or substantially triangular frame structure having a large central through hole 21. The stationary base member 13 forms an approximately or substantially plate-like shape except that it has the large central through hole 21. A pair of male screw members 23*a* and 23*b* inserted in upper and lower screw insertion holes 22*a* and 22*b* attach and fix the stationary base member 13, as shown in FIG. 12, to the head protecting body 2 shown in FIG. 11. Note that as shown in FIG. 11, a pair of upper and lower female screw members 24*a* and 24*b* are fixed, in a buried state, to a portion of the outer shell 5 behind the window opening 7 (that is, the right side in FIG. 11). To attach and fix the stationary base member 13, the pair of male screw members 23*a* and 23*b* are screwed and fixed in screw holes 25*a* and 25*b* of the pair of upper and lower female screw members 24*a* and 24*b* from the outer surface of the stationary base member 13. The inner surface of the stationary base member 13 preferably forms an arcuate shape which slightly rises toward the outer surface so as to substantially coincide with the arcuate shape of the outer surface of the outer shell 5. The movable base member 14 also preferably forms such an arcuate shape.

As shown in FIG. 9, the stationary base member 13 includes a pair of upper and lower high-level portions 28*a* and 28*b* formed from thick portions so as to surround the pair of upper and lower male screw members 23*a* and 23*b* (in other words, the pair of upper and lower screw insertion holes 22*a* and 22*b* which receive the pair of upper and lower male screw members 23*a* and 23*b*, respectively), respectively. The pair of high-level portions 28*a* and 28*b* have a pair of upper and lower guide grooves 26*a* and 26*b* and a pair of upper and lower guide grooves 27*a* and 27*b* substantially on the upper and lower sides of the pair of upper and lower screw insertion holes 22*a* and 22*b*, respectively. In this case, the direction of depth of each of the upper guide grooves 26*a* and 27*a* can be substantially downward substantially from above. The direction of depth of each of the lower guide grooves 26*b* and 27*b* can be substantially upward substantially from below. The stationary base member 13 has a pair of upper and lower spring accommodating recesses 32*a* and 32*b*, at portions on its outer surface substantially behind the pair of upper and lower male screw members 23*a* and 23*b*, to accommodate a pair of upper and lower repulsive coil springs 31*a* and 31*b* serving as elastic biasing means. Spring engaging projections 33*a* and 33*b* are formed on the wall portions substantially on the front side of the pair of upper and lower recesses 32*a* and 32*b*.

As shown in FIG. 9, a high-level portion 34 formed from a thick portion is formed in a region including the upper end and a vicinity thereof of the stationary base member 13. A downward guide groove 35 extending from the rear end midway to the front end of the high-level portion 34 is formed in the lower end face of the high-level portion 34. A high-level portion 36 formed from a thick portion is formed in a region including the intermediate portion and a vicinity thereof on the front side of the stationary base member 13 so as to be located between the central through hole 21 and the front end of the stationary base member 13. A substantially wavy thin click tooth portion 37 having one or a plurality of teeth (six teeth in FIG. 9), which can be substantially arcuate as a whole, projects from the front end of the high-level portion 36 to form an eaves structure concave on the inner surface side. A cam portion 38 having an inclined surface 38*b* is disposed at the lower front end of the high-level portion 36 so as to run below the click tooth portion 37 configured to hold the shield 4 stepwise. The end (in other words, the lower end) of the cam portion 38 on the side opposite to the click tooth portion 37 forms a stopper recess 38*a*. A cam face 39 for the shield 4 (more specifically, a third guided portion 123 to be described later) is formed on the stationary base member 13 by the click tooth portion 37, cam portion 38 and stopper recess 38*a*. A recess 41 to relieve the pivotal manipulation member 17 is formed obliquely below in a region including the lower end and a vicinity thereof of the stationary base member 13 so as to obliquely face forward. In addition, a stopper portion 42 serving as a stopper means and back-and-forth positioning means facing the recess 41 is disposed in the region including the lower end and the vicinity thereof of the stationary base member 13 so as to project toward the recess 41.

(2) Movable Base Member

Figure 10:
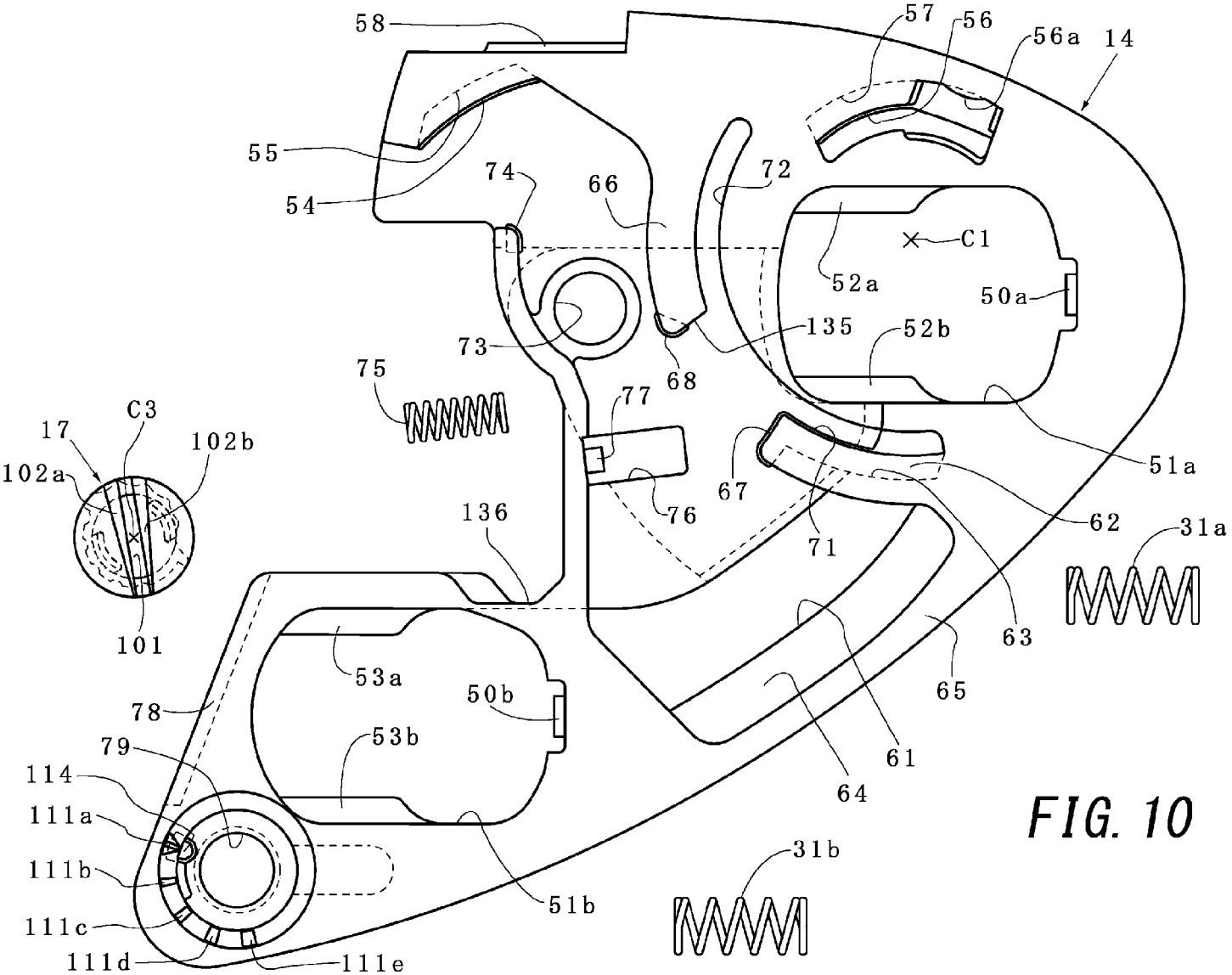
FIG. 10 is an enlarged front view of a movable base member shown in FIG. 9.
Figure 13:
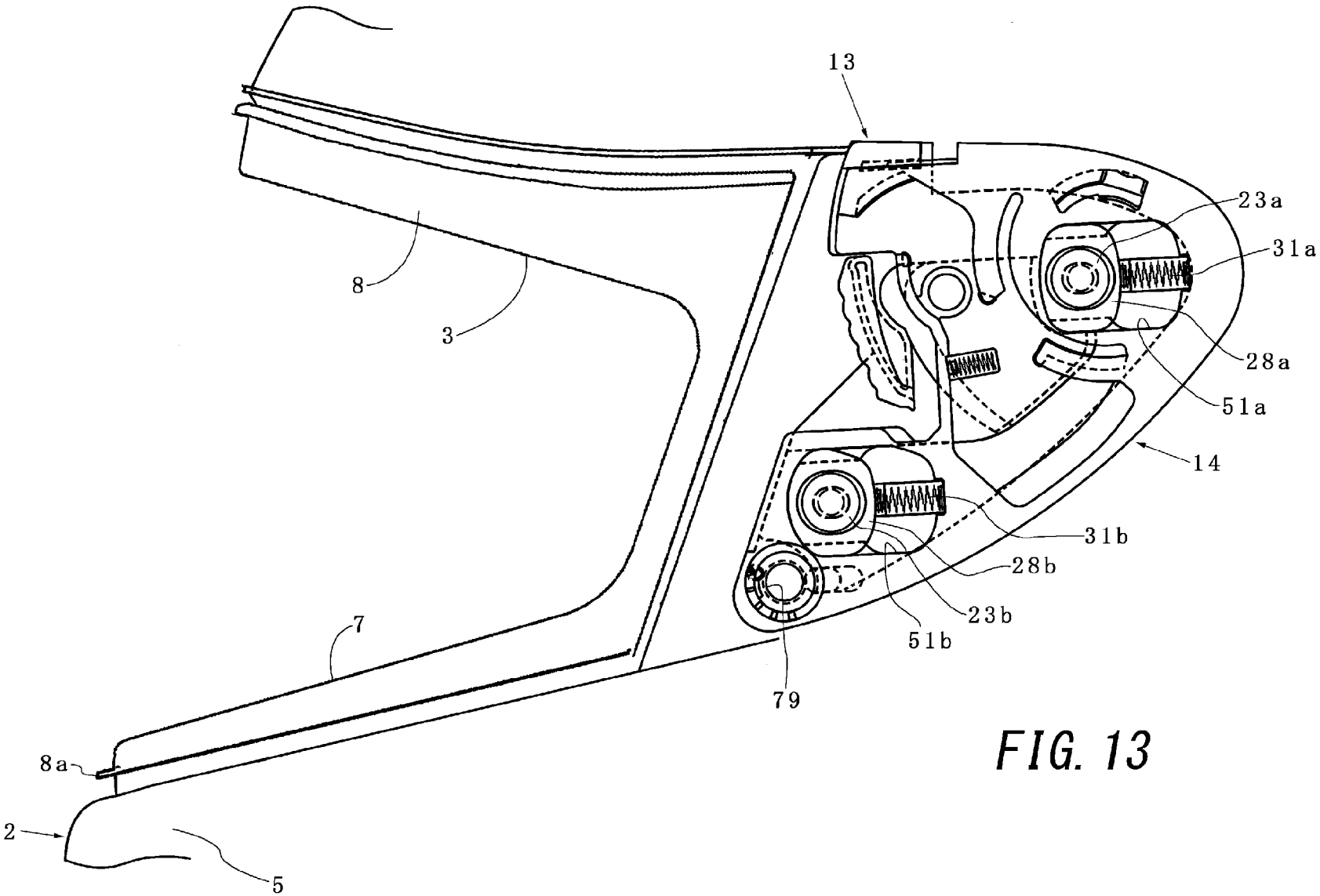
FIG. 13 is an enlarged left side view, similar to FIG. 11, of the helmet with the stationary base member and movable base member of the shield attaching mechanism being built into the head protecting body.

As shown in FIGS. 9, 10 and 13, the movable base member 14 of the shield attaching base member 15 has a perimeter larger than that of the stationary base member 13 substantially by one level, and forms a substantially plate-like shape larger than the stationary base member 13. The movable base member 14 has a pair of upper and lower through holes 51*a* and 51*b*, as shown in FIGS. 9 and 10. As shown in FIG. 13, the high-level portion 28*a*, where the pair of upper and lower guide grooves 26*a* and 26*b* substantially at the upper portion of the stationary base member 13 are formed, can be inserted in the upper through hole 51*a*. A high-level portion 28*b*, where the pair of upper and lower guide grooves 27*a* and 27*b* substantially at the lower portion of the stationary base member 13 are formed, can be inserted in the lower through hole 51*b*. A pair of upper and lower guided projecting ridges 52*a* and 52*b* are formed on the front portions of the upper and lower side wall portions of the circumferential wall portion of the upper through hole 51*a*, respectively. In addition, a spring engaging projection 50*a* configured to engage with the upper repulsive coil spring 31*a* is formed on the rear side wall portion of the circumferential wall portion. A pair of upper and lower guided projecting ridges 53*a* and 53*b* are formed on the front portions of the upper and lower side wall portions of the circumferential wall portion of the lower through hole 51*b*, respectively. In addition, a spring engaging projection 50*b* configured to engage with the lower repulsive coil spring 31*b* is formed on the rear side wall portion of the circumferential wall portion.

As shown in FIG. 10, the movable base member 14 has a substantially arcuate first guide portion 54 to be adjacent to the front upper end of the movable base member 14. Note that the first guide portion 54 is formed thin as its inner surface is recessed. The movable base member 14 has a substantially arcuate guide slit 55 to be adjacent to the inner surface of the lower end of the first guide portion 54. Hence, the guide portion 54 projects in the planar direction of the movable base member 14 to form an eaves structure. The movable base member 14 also has a substantially arcuate second guide portion 56 at a portion on the upper side of the upper through hole 51*a*. Note that the second guide portion 56 is formed thin as its inner surface is recessed. The movable base member 14 has a substantially arcuate guide slit 57 to be adjacent to the inner surface of the front end of the second guide portion 56. Hence, the second guide portion 56 projects in the planar direction of the movable base member 14 to form an eaves structure. Furthermore, a guide projecting ridge 58 projects from the front upper end of the movable base member 14.

As shown in FIG. 10, an intermediate through hole 61 is formed between the upper through hole 51*a* and lower through hole 51*b*. A substantially arcuate third guide portion 62 is formed between the upper through hole 51*a* and the intermediate through hole 61. Note that the third guide portion 62 is formed thin as its inner surface is recessed. The movable base member 14 has a substantially arcuate guide slit 63 to be adjacent to the inner surface of the end of the third guide portion 62 on the side of the through hole 51*a*. Hence, the third guide portion 62 projects in the planar direction of the movable base member 14 to form an eaves structure. Preferably, each of the center of the virtual circle of the substantially arcuate second guide portion 56 and the center of the virtual circle of the substantially arcuate third guide portion 62 substantially coincides with a common central point C1 shown in FIG. 10. Note that reference numeral 64 in FIG. 10 denotes an inclined surface obliquely adjacent to the lower rear portion of the intermediate through hole 61. The inclined surface 64 extends between the intermediate through hole 61 and a strip-shaped high-level portion 65 adjacent to the through hole 61 via the inclined surface 64 so as to incline in the widthwise direction obliquely upward from below.

As shown in FIG. 10, the movable base member 14 has a substantially arcuate fourth guide portion 66 formed substantially on the front side of the upper through hole 51*a*. Preferably, each of the center of the virtual circle of the substantially arcuate fourth guide portion 66 and the center of the virtual circle of the substantially arcuate third guide portion 62 substantially coincides with the common center C1 shown in FIG. 10. Also preferably, the radius (that is, each of the inner diameter and outer diameter) of the virtual circle of the fourth guide portion 66 substantially coincides with the radius (that is, each of the inner diameter and outer diameter) of the virtual circle of the third guide portion 62. A gap 67 is formed between the free end of the fourth guide portion 66 and the free end of the third guide portion 62. A first engaging portion 68 having an eaves structure, which can have a substantially triangular shape, is formed at the front corner of the distal end of the fourth guide portion 66. Substantially arcuate first and second guide grooves 71 and 72 are formed in the third guide portion 62 and the fourth guide portion 66, respectively, on the side of the central point C1.

As shown in FIG. 10, the movable base member 14 has a through hole (that is, attachment hole) 73 to attach the shield attaching/removing manipulation lever 16 at a portion adjacent to substantially the front side of first engaging portion 68. The movable base member 14 has a second engaging portion 74 having an eaves structure, which can have a substantially fan shape, at a portion substantially obliquely adjacent to the upper front portion of the through hole 73. The movable base member 14 also has a spring accommodating opening 76 configured to accommodate a repulsive coil spring 75 at a portion slightly below the through hole 73. A spring engaging projection 77 is formed on the wall portion substantially on the front side of the spring accommodating opening 76. A projecting wall portion 78 which can be elongated and have substantially linear shape is formed on the inner surface of the front end of the movable base member 14 so as to be located at a portion substantially in front of the lower through hole 51*b*. An attachment hole 79 to attach the pivotal manipulation button 17 is formed in a region including the lower front end and a vicinity thereof of the movable base member 14. Note that the attachment hole 79 will be described later in detail in "(4) pivotal manipulation button".

(3) Shield Attaching/Removing Manipulation Lever

Figure 14:
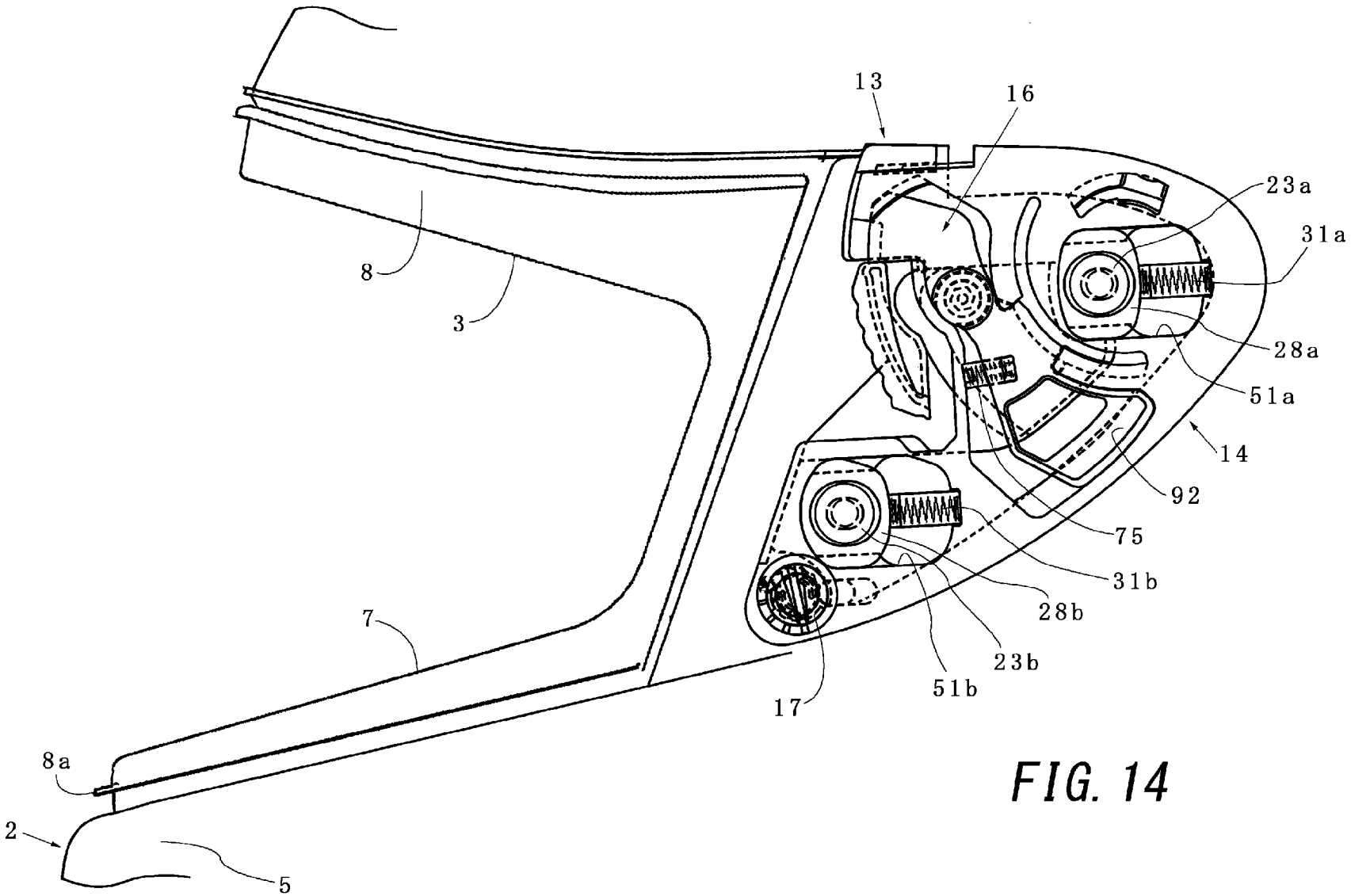
FIG. 14 is an enlarged left side view, similar to FIG. 2, of the helmet from which the shield has been removed.
Figure 15:
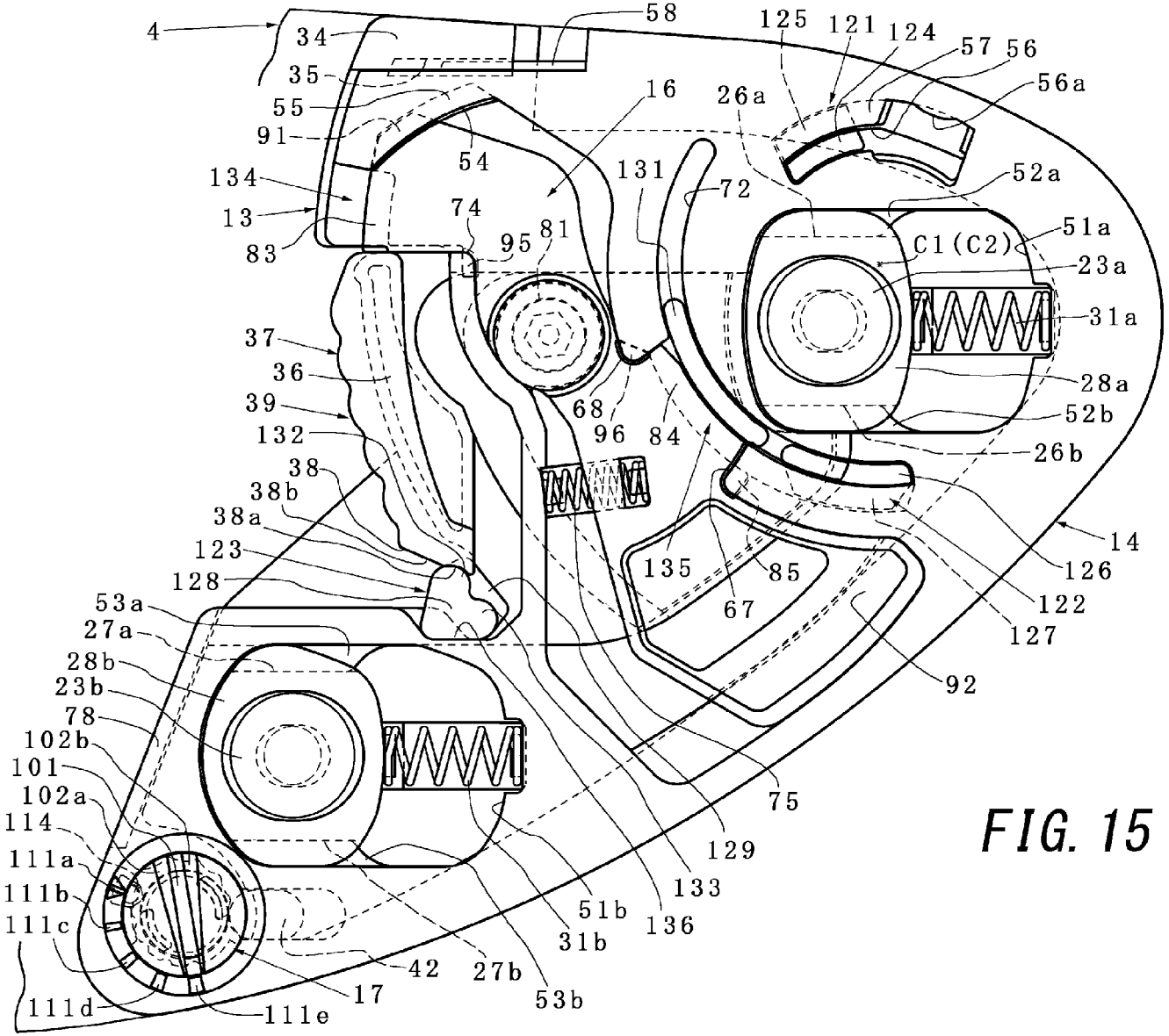
FIG. 15 is an enlarged left side view of the shield attaching mechanism shown in FIG. 2.
Figure 16:
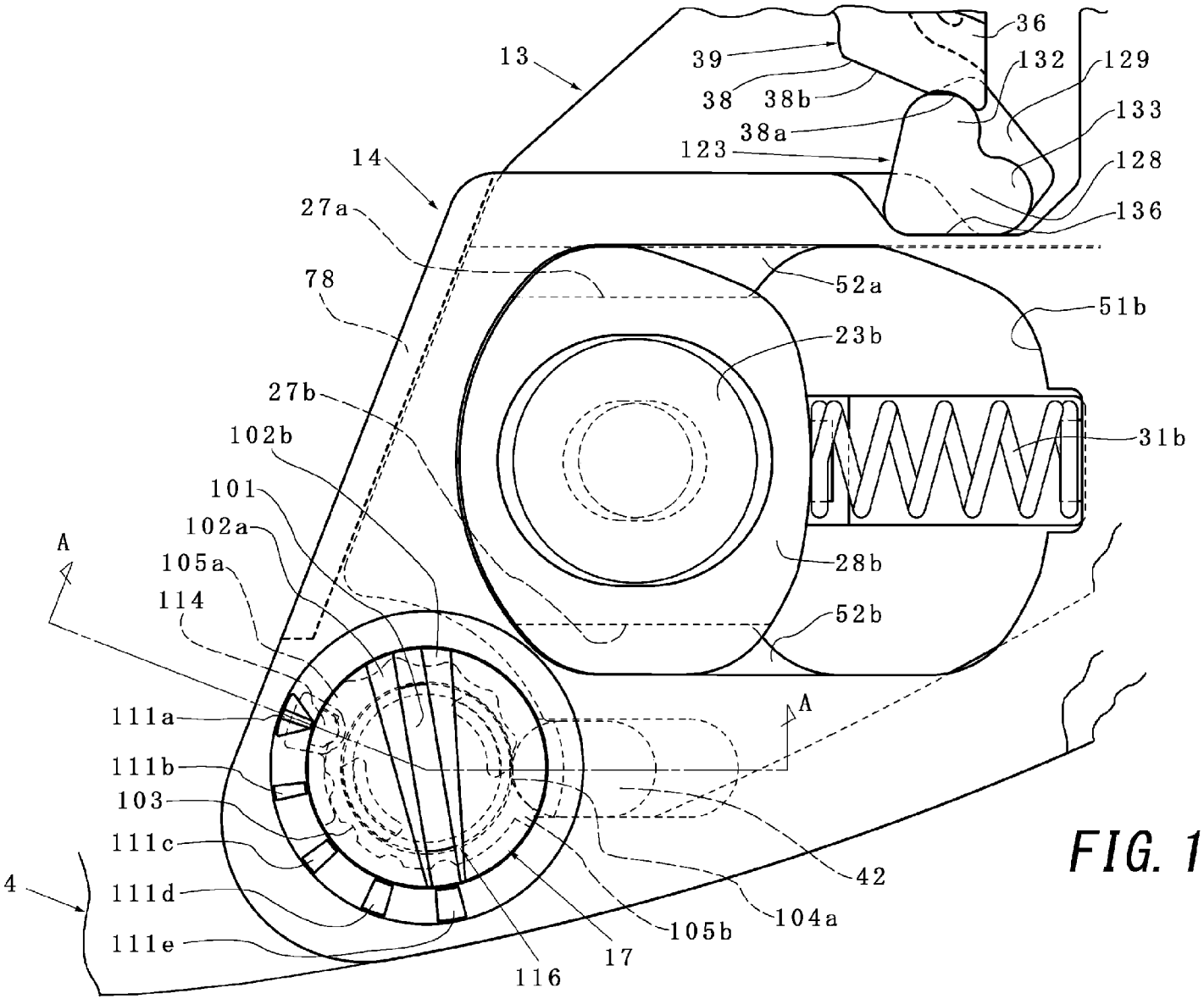
FIG. 16 is an enlarged left side view of part of the shield attaching mechanism shown in FIG. 15.
Figure 17:
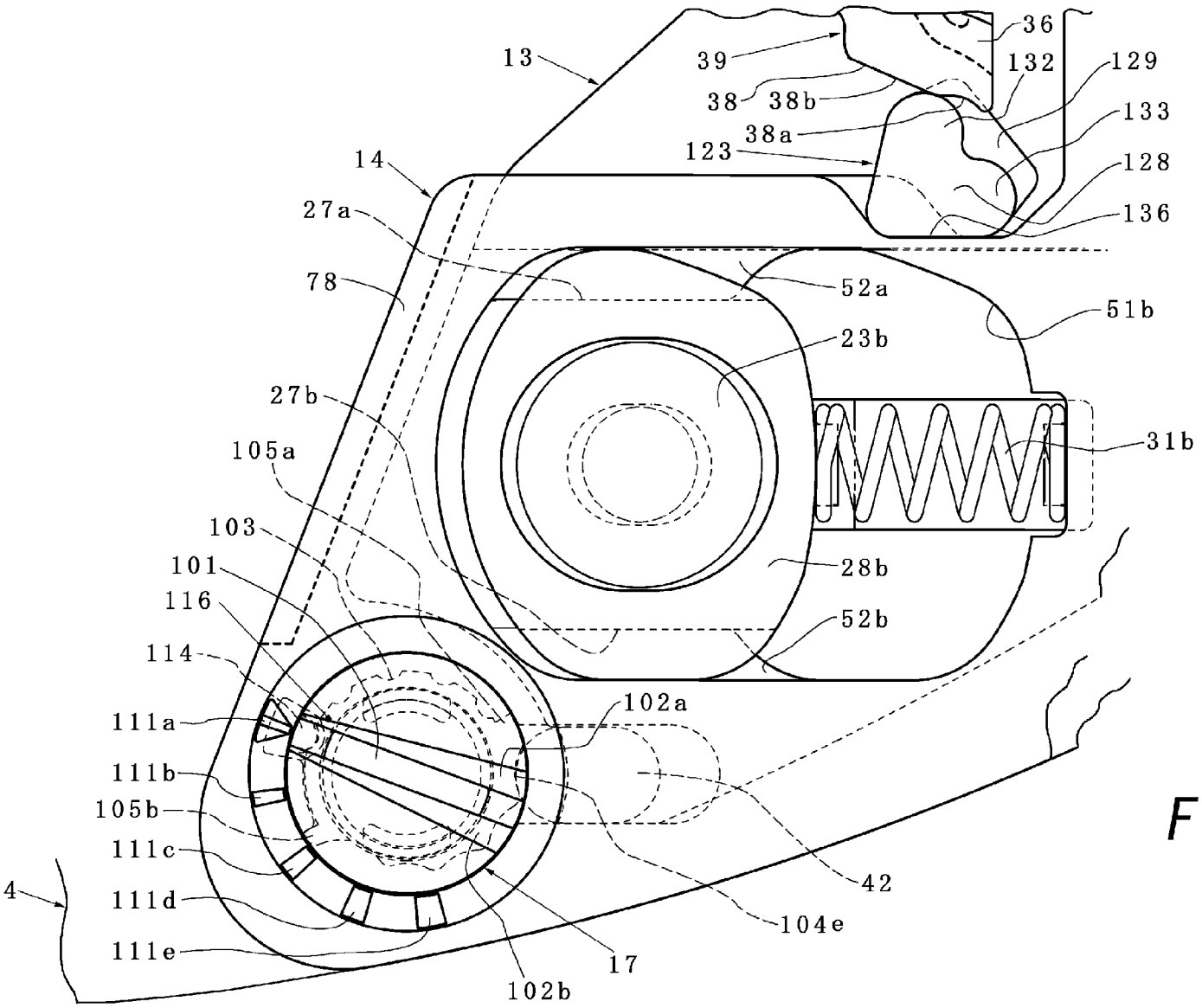
FIG. 17 is an enlarged left side view of a part of the shield attaching mechanism shown in FIG. 8.

The shield attaching/removing manipulation lever 16 which serves as the shield attaching/removing manipulation member forms a substantially thin plate-like elongated shape, as shown in FIGS. 9 and 14. The shield attaching/removing manipulation lever 16 has a pivot axis portion 81 with a screw insertion hole at approximately its intermediate portion. The manipulation lever 16 can pivotally be attached to the movable base member 14 by inserting the pivot axis portion 81 in the through hole 73 of the movable base member 14 from the outer surface of the movable base member 14 and thereafter screwing and fixing a male screw member (not shown) into the screw insertion hole via a safety lock member (not shown) from the inner surface of the movable base member 14.

The shield attaching/removing manipulation lever 16 has a first engaging pawl (in other words, a first lock pawl) 83 at a portion above the pivot axis portion 81 and a second engaging pawl (in other words, a second lock pawl) 84 at a portion below the pivot axis portion 81, as shown in FIGS. 9 and 14. Note that preferably, the first and second engaging pawls 83 and 84 have recessed inner surfaces so they become thin, and their outer surfaces are inclined to their inner surfaces from their proximal ends toward their distal ends so their thicknesses gradually decrease. Hence, each of the first and second engaging pawls 83 and 84 projects in the planar direction of the manipulation lever 16 to form an eaves structure. The manipulation lever 16 has a third engaging pawl (in other words, a third lock pawl) 85 in a region including a portion (and a vicinity thereof) below the second engaging pawl 84. Note that the third engaging pawl 85 lacks the outer surface side and is formed thin only from the inner surface side. As shown in FIG. 14, the substantially arcuate guide 62 of the movable base member 14 engages with the third engaging pawl 85 to prevent the manipulation lever 16 from suspending upward from the movable base member 14. Also, as shown in FIGS. 9 and 14, the shield attaching/removing manipulation lever 16 has a substantially arcuate guided portion 91, substantially at its upper end, which is thin as its outer surface is recessed.

As shown in FIG. 9, a ring-like finger rest 92, where the helmet wearer can place his fingers when pivoting the manipulation lever 16 forward, is integrated with the shield attaching/removing manipulation lever 16 at its lower end. A spring accommodating recess 93, which is open not only to the inner surface but also to the front side, is formed in the inner surface of the shield attaching/removing manipulation lever 16, between the pivot axis portion 81 and the finger rest 92, so as to oppose the spring accommodating opening 76 of the movable base member 14. A spring engaging projection 94 is formed on the rear side wall portion of the spring accommodating recess 93. The spring accommodating opening 76 of the movable base member 14 and the spring accommodating recess 93 of the shield attaching/removing manipulation lever 16 accommodate the repulsive coil spring 75 such that its two ends engage with the spring engaging projections 77 and 94, as shown in FIG. 14.

As shown in FIG. 9, a fourth engaging pawl (in other words, a fourth lock pawl) 95 is integrated with the shield attaching/removing manipulation lever 16 on its front side between the first engaging pawl 83 and the pivot axis portion 81. Note that the fourth engaging pawl 95 lacks the outer surface side and is formed thin only from the inner surface side. Additionally, a fifth engaging pawl (in other words, a fifth lock pawl) 96 is integrated with the shield attaching/removing manipulation lever 16 on its rear side surface between the pivot axis portion 81 and the second engaging pawl 84. Note that the fifth engaging pawl 96 also lacks the outer surface side and is formed thin only from the inner surface side. As shown in FIG. 14, the first engaging portion 68 and the lower end of the third guide portion 62 of the movable base member 14 engage the fourth and fifth engaging pawls 95 and 96 to prevent the manipulation lever 16 from suspending upward from the movable base member 14.

(4) Pivotal Manipulation Button

As shown in FIGS. 9, 10 and 15 to 20, the pivotal manipulation button 17 functioning as a shield position adjustment operation member such as a shield position adjustment pivotal manipulation member includes a head portion 97 having a substantially disk-like shape, an intermediate portion 98 having a substantially disk-like shape and concentrically and integrally connected with the lower side of the head portion 97, and a pair of left and right legs 99*a* and 99*b* integrally connected with the lower side of the intermediate portion 98 and extending substantially downward from the intermediate portion 98. The upper surface of the head portion 97 has a groove 101 passing through the center portion of the upper surface while substantially extending through the head portion 97, and a pair of projecting ridges 102*a* and 102*b* extending along both sides of the groove 101. The intermediate portion 98 has a diameter smaller than that of the head portion 97. A plurality of (preferably three to seven, more preferably four to six, and in the illustrated embodiment, five) positioning recesses 103 are formed in a circumferential half of the outer periphery of the intermediate portion 98. A plurality of (preferably three to seven, more preferably four to six, and in the illustrated embodiment, five) stopper engaging recesses 104*a* to 104*e* are formed in the other circumferential half of the outer periphery of the intermediate portion 98. Note that the number of the positioning recesses 103 is preferably equal to the number of stopper engaging recesses 104*a* to 104*e* serving as stopped means or first recess/projection engaging means. The plurality of positioning recesses 103 serving as second recess/projection engaging means can have the same shape each other and are therefore located substantially equidistantly from a pivot center C3 of the pivotal manipulation button 17. The plurality of stopper engaging recesses 104*a* to 104*e* are preferably located at different distances from the pivot center C3. In the illustrated embodiment, starting from the stopper engaging recess 104*a* out of the stopper engaging recesses 104*a* to 104*e*, the distance sequentially increases in the order of the stopper engaging recesses 104*b*, 104*c*, 104*d* and 104*e*.

Figure 18:
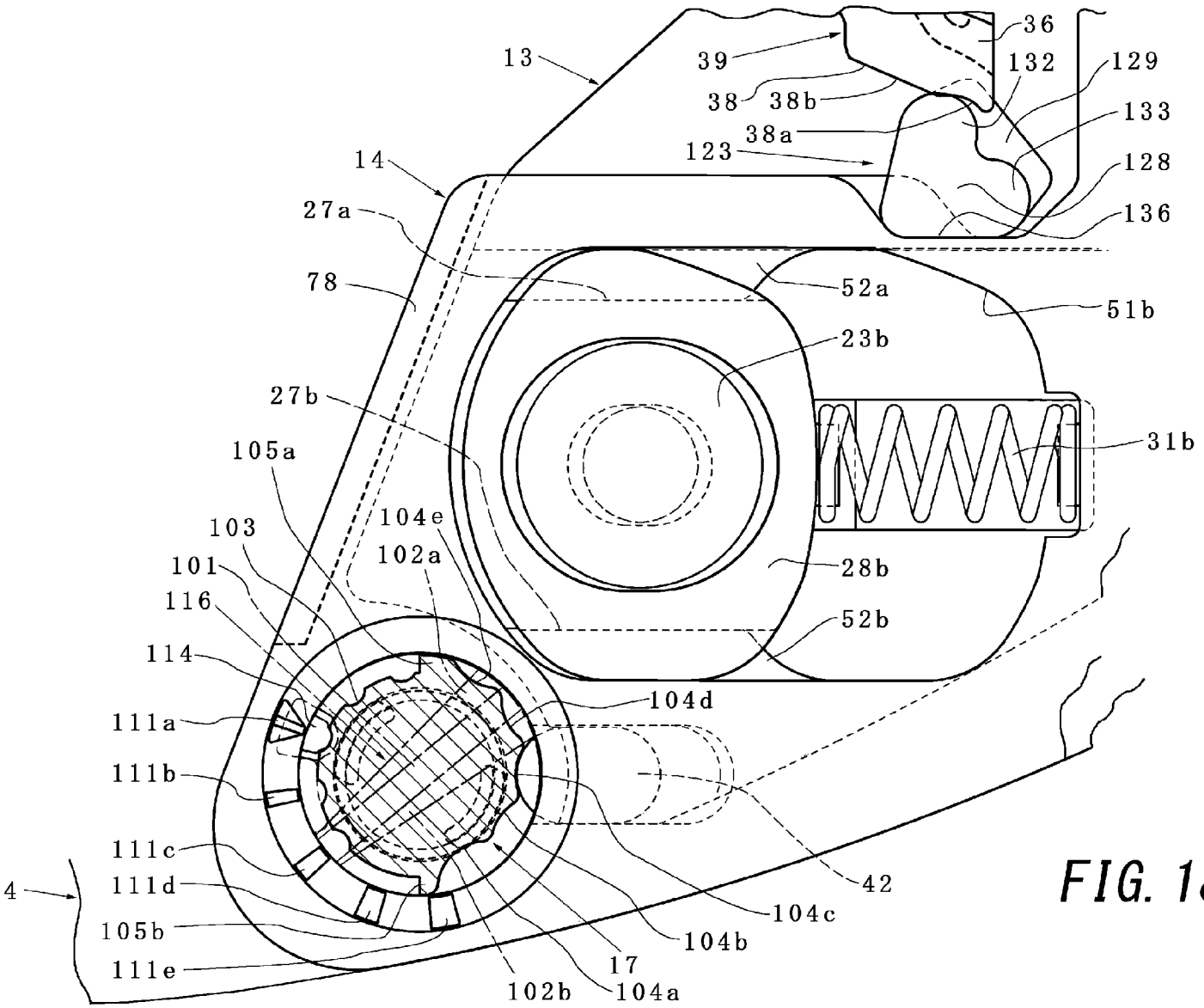
FIG. 18 is an enlarged left side view of a part of the shield attaching mechanism when a shield position adjustment pivotal manipulation button is set in an intermediate state between the state shown in FIG. 16 and the state shown in FIG. 17.
Figure 20:
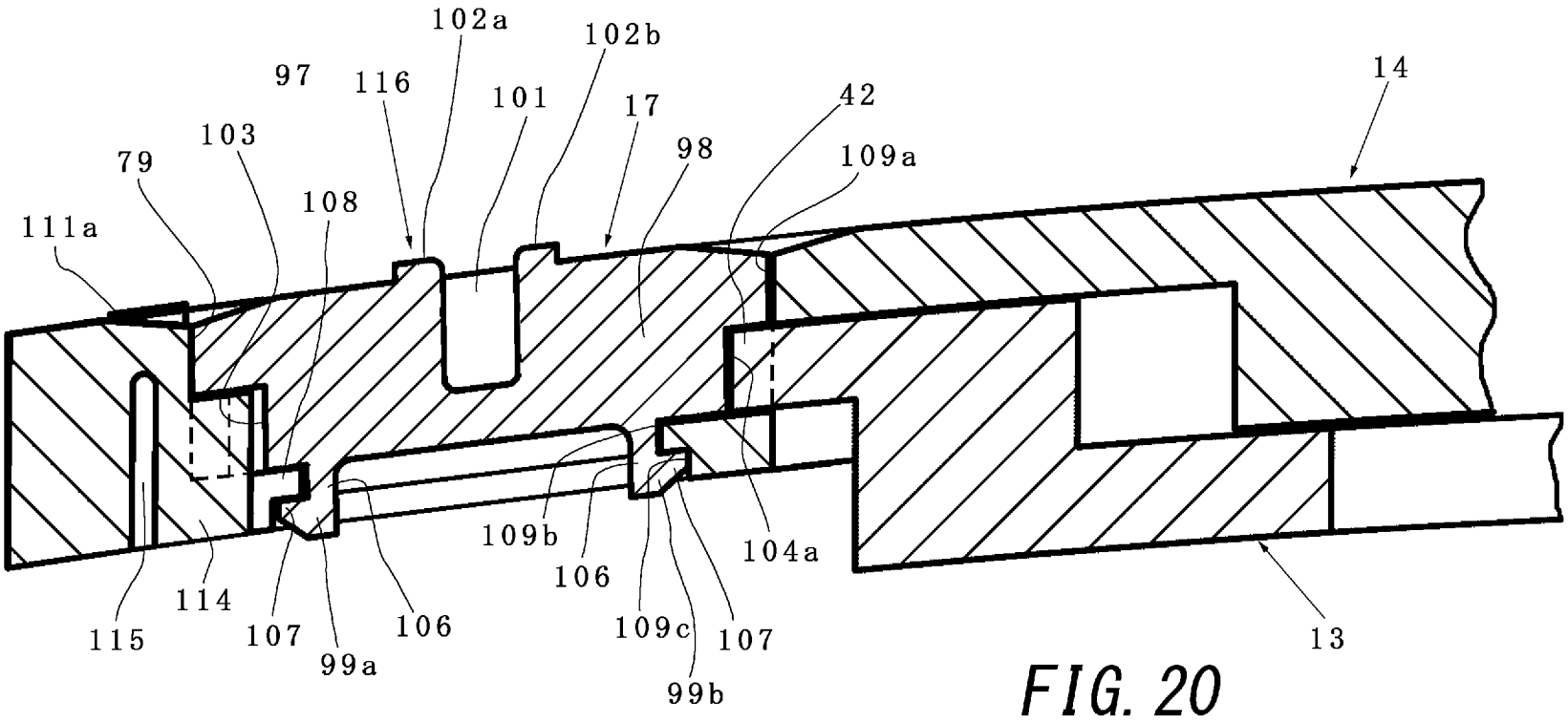
FIG. 20 is a sectional view taken along a line A-A in FIG. 16.

As shown in FIGS. 18, 20, and the like, the intermediate portion 98 of the pivotal manipulation button 17 has first and second stopped portions 105*a* and 105*b* integrated with the intermediate portion 98 between the plurality of positioning recesses 103 and the plurality of stopper engaging recesses 104*a* to 104*e*. Note that the first stopped portion 105*a* and the second stopped portion 105*b* are limited by a first positioning projection 114 and a second positioning projection 117 not to pivot more than necessary. Each of the pair of left and right legs 99*a* and 99*b* includes a leg main body 106 extending substantially downward from the intermediate portion 98, and an engaging projection 107 projecting substantially outward substantially in the transverse direction from the lower end of the leg main body 106. As shown in FIG. 20, the intermediate portion 98 of the pivotal manipulation button 17 is fitted in the hole 79 formed in a region including the lower end and a vicinity thereof of the movable base member 14. In the fitted state, the pair of left and right legs 99*a* and 99*b* of the pivotal manipulation button 17 engages with the inner surface of a substantially circular engaging projecting ridge 108 of the movable base member 14 on the outer periphery of the hole 79. Note that the hole 79 can have a large diameter on an outer side 109*a*, a small diameter at an intermediate portion 109*b*, and an intermediate diameter on an inner side 109*c*. The projections 107 of the pair of legs 99*a* and 99*b* abut against the intermediate portion 109*b* from the inner side 109*c* and are locked.

As shown in FIGS. 10, 20, and the like, the movable base member 14 has, on the outer periphery of the outer surface of the hole 79, a plurality of (preferably three to seven, and in the illustrated embodiment, five) markings 111*a* to 111*e* which partially surround the outer periphery and indicate the pivotal state of the pivotal manipulation button 17. Note that a pointer 116 capable of facing the markings 111*a* to 111*e* is formed from the groove 101 and the pair of left and right projecting ridges 102*a* and 102*b* provided on the left and right sides of the groove 101. The markings 111*b* to 111*e* are formed from substantially trapezoidal projecting ridges which sequentially increase the width in the illustrated embodiment. In the illustrated embodiment, the marking 111*a* is formed from a substantially triangular projecting ridge 112 and a projecting ridge 113 extending on the substantially triangular projecting ridge 112 while extending through it substantially in the vertical direction. In the hole 79 of the movable base member 14, the positioning projection 114 serving as a pivot or rotation preventing means is integrated with the movable base member 14. A slit 115 is formed in the movable base member 14 on the proximal end side of the positioning projection 114 such that the positioning projection 114 can elastically move substantially forward and backward with respect to the pivot center of the pivotal manipulation button 17. As shown in FIGS. 18, 20, and the like, the stopper portion 42 disposed on the stationary base member 13 selectively engages with one of the stopper engaging recesses 104*a* to 104*e* of the pivotal manipulation button 17. Note that this engagement is reliably done as the repulsive coil springs 31*a* and 31*b* elastically bias the movable base member 14 with respect to the stationary base member 13 from left to right in FIGS. 18 and 20.

(5) Shield

As shown in FIG. 9, a substantially arcuate first guided portion 121, substantially arcuate second guided portion 122 and substantially arcuate third guided portion 123 are sequentially formed, in a region including the left end of the inner surface and a vicinity thereof of the shield 4 to locate from the left distal end substantially to the central portion side of the shield 4. Note that preferably, the center of the virtual circle of the substantially arcuate first guided portion 121 and the center of the virtual circle of the substantially arcuate second guided portion 122 coincide with a substantially common central point C2 shown in FIG. 9. As an end of the first guided portion 121 on a side opposite to the central point C2 is recessed on its outer surface (that is, a surface on the outer surface side of the shield 4) side, the first guided portion 101 projects in a direction opposite to the central point C2 to form an eaves structure. Hence, in the first guided portion 121, a base wall portion 124 substantially vertically rising from the inner surface of the shield 4, and an eaves portion 125 extending from the base wall portion 124 substantially parallel to the inner surface of the shield 4 are integrated with each other. As an end of the second guided portion 122 on a side opposite to the central point C2 is recessed on its outer surface side, as shown in FIG. 9, the second guided portion 122 projects in a direction opposite to the central point C2 to form an eaves structure. Hence, in the second guided portion 122 as well, a base wall portion 126 substantially vertically rising from the inner surface of the shield 4 and, an eaves portion 127 extending from the base wall portion 126 substantially parallel to the inner surface of the shield 4 are integrated with each other. Furthermore, as an end of the third guided portion 123 on the side of the central point C2 is recessed on its outer surface side, the third guided portion 123 projects in the direction of the central point C2 to form an eaves structure. Hence, in the third guided portion 123 as well, a base wall portion 128 substantially vertically rising from the inner surface of the shield 4, and an eaves portion 129 extending from the base wall portion 128 substantially parallel to the inner surface of the shield 4 are integrated with each other.

As shown in FIG. 9, an arcuate guided wall portion 131 serving as a fourth guided portion is formed on the inner surface of the shield 4 at a small interval from the second guided portion 122. Note that the center of the virtual circle of the arcuated guided wall portion 131 also preferably substantially coincides with the central point C2. The distance from the arcuated guided wall portion 131 to the central point C2 is preferably substantially the same as the distance from the base portion 128 of the second guided portion 122 to the central point C2. The fourth guided portion 131 is preferably formed on the inner surface of the shield 4 at a position obliquely adjacent to the upper side of the base wall portion 126 of the second guided portion 122. The base portion 128 of the third guided portion 123 is preferably formed into a columnar body having a substantially heart-shaped cross section. In the base portion 128, two tooth portions 132 and 133 each capable of functioning as a stopper are arranged adjacently on a common arc with respect to the central point C2 as the center so as to substantially face the central point C2. Note that the tooth portions 132 and 133 arranged on the common arc need not always be two tooth portions, and one or three or more tooth portions may be arranged.

(6) Assembly of Shield Attaching Mechanism

When assembling the shield attaching mechanism 6 shown in FIG. 2, operations described in the following items (a) to (e) can sequentially be performed:

(a) to attach the pivotal manipulation button 17 to the movable base member 14, (b) to attach the movable base member 14 to the stationary base member 13, (c) to attach the shield attaching/removing manipulation lever 16 to the movable base member 14, (d) to attach a pair of left and right combination structures each comprising the four members 13, 14, 16 and 17 to the left and right sides of the outer surface of the head protecting body 2, and (e) to attach regions including the left and right ends and vicinities thereof of the shield to the movable base members 14 on the left and right sides of the head protecting body 2.

The assembling operation of the shield attaching mechanism 6 will be described below sequentially in the order described in the above items (a) to (e). Note that as the right shield attaching mechanism 6 can be assembled in the substantially same manner as that of the assembly of the left shield attaching mechanism 6, only the assembling operation of the left shield attaching mechanism 6 will be described below.

Figure 19:
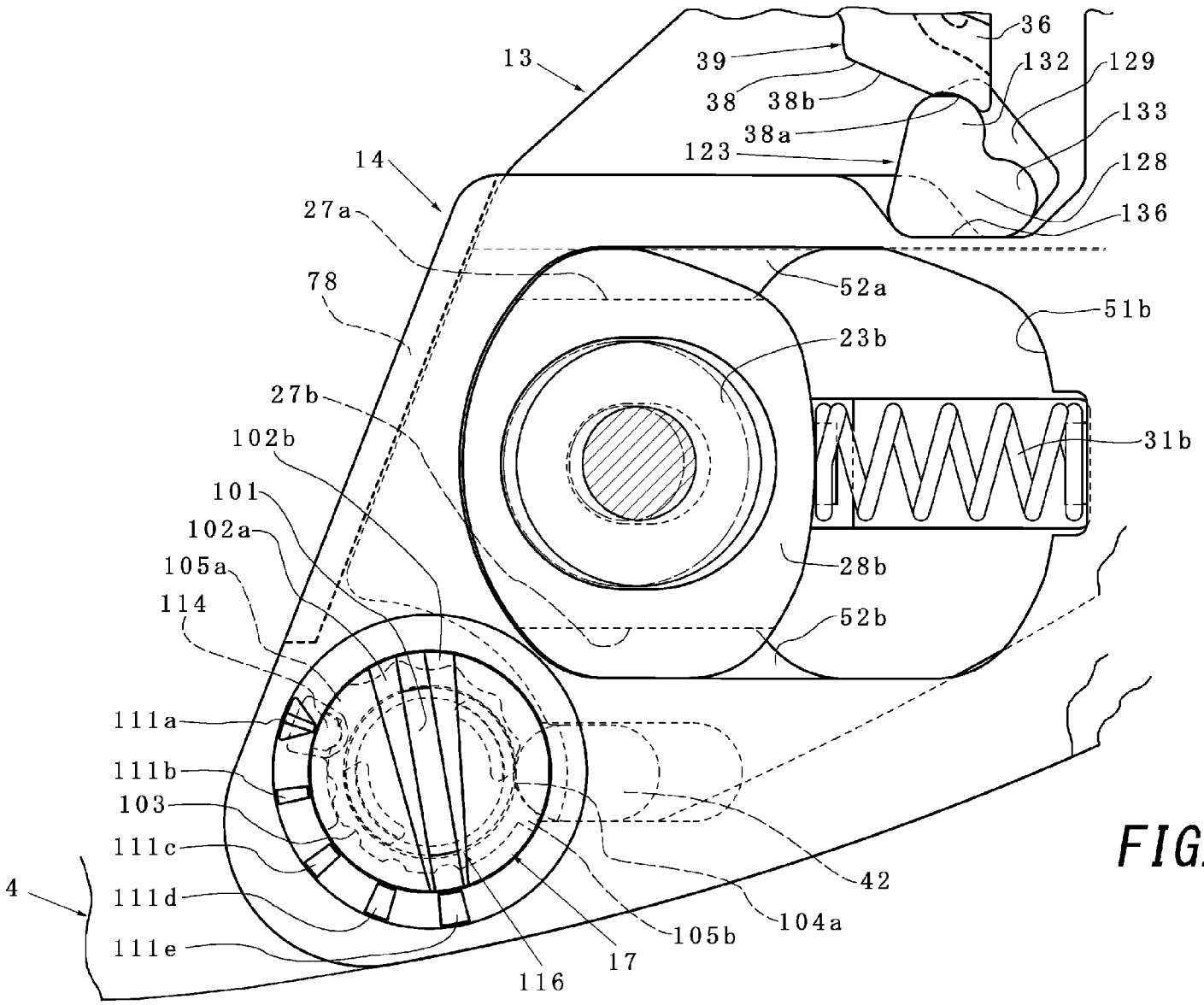
FIG. 19 is an enlarged left side view of a part of the shield attaching mechanism when the stationary base member attachment position is changed in the state shown in FIG. 16.

When attaching the pivotal manipulation button 17 shown in FIGS. 10 and 20 to the movable base member 14 shown in FIG. 10, as described in the above item (a), the inner surface of the pivotal manipulation button 17 is overlaid on the outer surface in a region including the attachment hole 79 and a vicinity thereof of the movable base member 14, as shown in FIG. 19. The positioning projection 114 of the movable base member 14 is aligned with one of the plurality of positioning recesses 103 of the pivotal manipulation button 17. After that, the pivotal manipulation button 17 is pressed into the hole 79. At this time, engaging projections 107*a* and 107*b* of the pair of left and right legs 99*a* and 99*b* of the pivotal manipulation button 17 are engaged by the engaging projecting ridge 108. The positioning projection 114 of the movable base member 14 engages with one of the positioning recesses 103 of the pivotal manipulation button 17.

When attaching the movable base member 14 shown in FIGS. 9 and 10 to the stationary base member 13 shown in FIG. 9, as described in the above item (b), the inner surface of the movable base member 14 is overlaid on the outer surface of the stationary base member 13, as in the case shown in FIG. 13. The upper pair of upper and lower guided projecting ridges 52*a* and 52*b* and the lower pair of upper and lower guided projecting ridges 53*a* and 53*b* of the movable base member 14 are relatively fitted in the upper pair of upper and lower guide grooves 26*a* and 26*b* and the lower pair of upper and lower guide grooves 27*a* and 27*b* of the stationary base member 13, respectively. At this time, the guide projecting ridge 58 of the movable base member 14 is fitted in the guide groove 35 of the stationary base member 13. Subsequently, the pair of upper and lower repulsive coil springs 31*a* and 31*b* are respectively accommodated in the pair of upper and lower spring accommodating recesses 32*a* and 32*b* of the stationary base member 13. At this time, the two ends of the upper repulsive coil spring 31*a* engage with the spring engaging projections 33*a* and 50*a*, respectively. In addition, the two ends of the lower repulsive coil spring 31*b* engage with the spring engaging projections 33*b* and 50*b*, respectively. In this state, as shown in FIG. 13, the pair of upper and lower repulsive coil springs 31*a* and 31*b* elastically bias the movable base member 14 substantially backward (that is, substantially to the right in FIG. 13) to hold it at the backward position. More specifically, the movable base member 14 is held at the backward position when one of the plurality of stopper engaging recesses 104*a* to 104*e* of the pivotal manipulation button 17 abuts against the stopper portion 42 of the stationary base member 13, as shown in FIGS. 18, 20, and the like.

When attaching the shield attaching/removing manipulation lever 16 shown in FIG. 9 to the movable base member 14 shown in FIGS. 9 and 10, as described in the above item (c), the inner surface of the manipulation lever 16 is overlaid on the outer surface of the movable base member 14, as shown in FIG. 14. At this time, the pivot axis portion 81 is inserted in the through hole 73 of the movable base member 14 from the outer surface of the movable base member 14. A male screw member (not shown) is screwed and fixed in the screw insertion hole of the pivot axis portion 81 via a safety lock member (not shown) from the inner surface of the movable base member 14. As a result, the manipulation lever 16 is pivotally axially supported by the movable base member 14. The common repulsive coil spring 75 is accommodated in the spring accommodating opening 76 of the movable base member 14 and the spring accommodating recess 93 of the manipulation lever 16. At this time, the two ends of the repulsive coil spring 75 engage with the spring engaging projections 77 and 94, respectively. Simultaneously, the guided portion 91 of the manipulation lever 16 is inserted in the guide slit 55 of the guide portion 54 of the movable base member 14. The third engaging pawl 85 of the manipulation lever 16 is inserted in the inner surface side of the third guide portion 62 of the movable base member 14. Additionally, the fifth engaging pawl 96 of the manipulation lever 16 is inserted in the inner surface side of the first engaging portion 68 of the movable base member 14. Furthermore, the fourth engaging pawl 95 of the manipulation lever 16 is inserted in the inner surface side of the second engaging portion 74 of the movable base member 14.

In the state where the shield attaching/removing manipulation lever 16 is pivotally axially supported by the movable base member 14, as described above, the repulsive coil spring 75 elastically biases the manipulation lever 16 counterclockwise in FIG. 14 about the pivot axis portion 81 as the fulcrum, to dispose the manipulation lever 16 at the backward pivotal position, as shown in FIG. 14. A first predetermined portion of the manipulation lever 16 abuts against a second predetermined portion of the stationary base member 13. In this case, the first predetermined portion can be the upper surface of the finger rest 92 of the shield manipulation lever 16 in FIG. 9 or another abutting portion. The second predetermined portion can be the upper surface of the third guide 62 of the movable base member 14 in FIG. 9 or another abutting portion (in other words, a portion against which the first predetermined portion can abut). Note that the manipulation lever 16 can pivot forward against the elastic biasing force of the repulsive coil spring 75 until the finger rest 92, the end on the opposite side or another abutting portion abuts against the corresponding abutting portion of the movable base member 14. When the manipulation lever 16 is at the backward pivotal position described above, its first engaging pawl 83 substantially closes a gap 134 between a region including the upper end of the high-level portion 36 and a vicinity thereof of the stationary base member 13 and a region including the front end and a vicinity thereof of the first guide 54 of the movable base member 14, as shown in FIG. 14. The second engaging pawl 84 of the manipulation lever 16 substantially closes a gap 135 between the front end of the third guide 62 of the movable base member 14 and the lower end of the fourth guide 66.

When attaching the assembly structure comprising the four members 13, 14, 16 and 17 shown in FIG. 9 to the left side of the outer surface of the head protecting body 2, as described in the above item (d), first, the pair of male screw members 23*a* and 23*b* shown in FIG. 9 are inserted in the pair of upper and lower screw insertion holes 22*a* and 22*b* of the stationary base member 13. Subsequently, the pair of male screw members 23*a* and 23*b* are screwed and fixed in the pair of screw holes 25*a* and 25*b* shown in FIG. 11 for the pair of male screw members 23*a* and 23*b*. In this case, the pair of upper and lower screw insertion holes 22*a* and 22*b* of the stationary base member 13 are formed long substantially in the horizontal direction. For this reason, the attachment position of the stationary base member 13 (in other words, the four members 13, 14, 16 and 17) with respect to the head protecting body 2 substantially in the horizontal direction (in other words, substantially in the back-and-forth direction) can be adjusted to some extent, as shown in FIG. 19.

Figure 6:
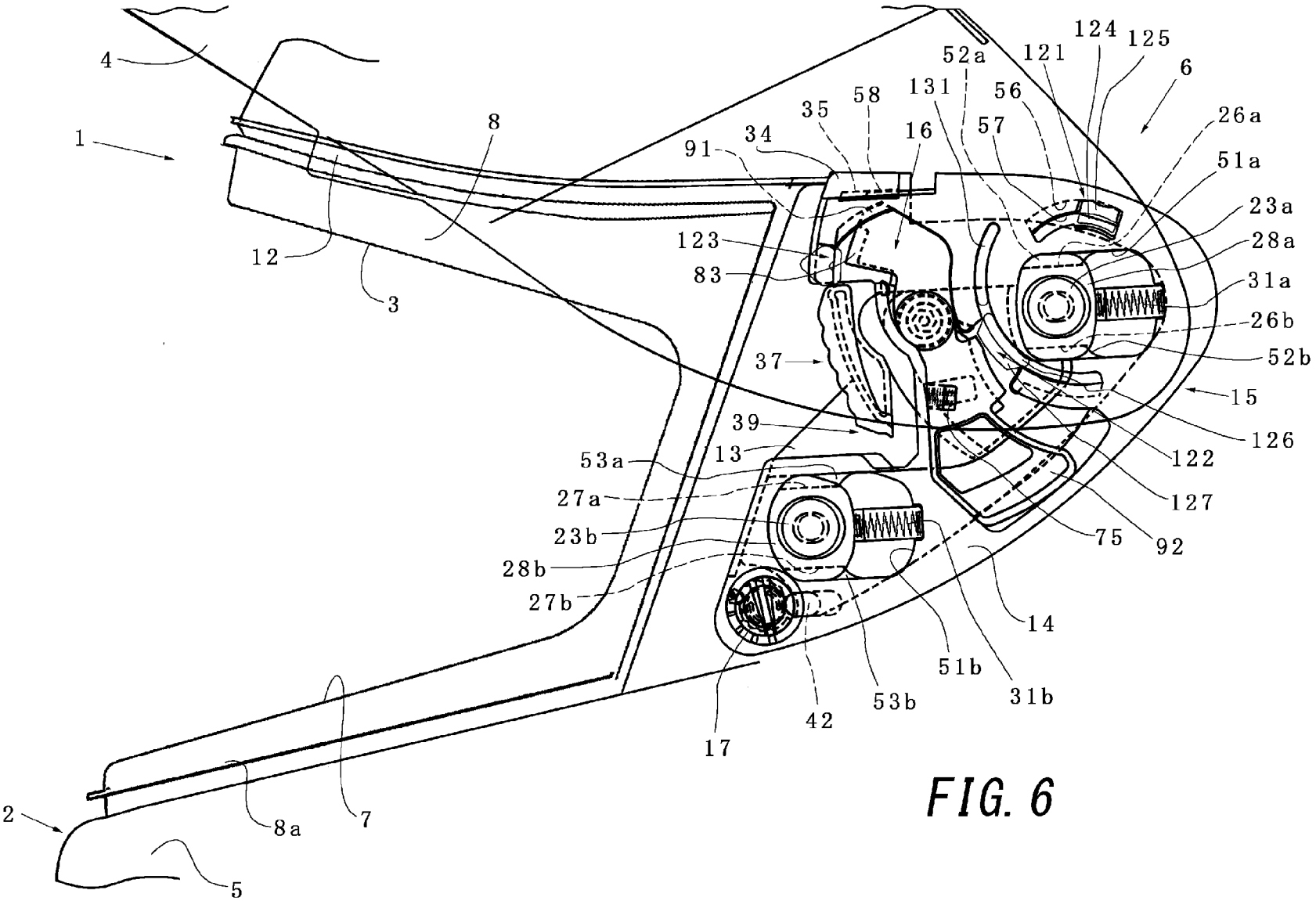
FIG. 6 is an enlarged left side view, similar to FIG. 5, of a state wherein a shield attaching/removing manipulation lever is pivoted forward.

When attaching the left end of the shield 4 to the movable base member 14, as described in the above item (e), the shield attaching/removing manipulation lever 16 shown in FIG. 14 may be pivoted forward clockwise in FIG. 14 in advance about the pivot axis portion 81 as the fulcrum against the elastic biasing force of the repulsive coil spring 75 (see FIG. 6). However, the manipulation lever 16 need not always be operated in this manner. In place of this operation, the first guided portion 121, second guided portion 122 and third guided portion 123 of the shield 4 may be abutted against the second guide 56 of the movable base member 14 and the second lock pawl 84 and first lock pawl 83 of the shield attaching/removing manipulation lever 16, respectively, and thereafter a region including the left end and a vicinity thereof of the shield 4 may be strongly urged against the movable base member 14. In this case, the second and third guided portions 122 and 123 of the shield 4 strongly urge the second and first lock pawls 84 and 83 of the manipulation lever 16. For this reason, the manipulation lever 16 pivots forward against the elastic biasing force of the repulsive coil spring 75, in the substantially same manner as in the case of the forward pivot operation described above. Consequently, the first guided portion 121 of the shield 4 is inserted in an opening 56*a* of the second guide 56 of the movable base member 14. Simultaneously, the second guided portion 122 of the shield 4 is positioned in the gap 67 of the movable base member 14. In addition, the fourth guided portion 131 of the shield 4 is positioned in the second guide groove 72 of the movable base member 14. Since the eaves portion 129 of the third guided portion 123 of the shield 4 presses the outer surface of the engaging pawl 83 of the manipulation lever 16, the manipulation lever 16 pivots clockwise in FIG. 14 about the pivot axis portion 81 as the fulcrum. For this reason, the third guided portion 123 is positioned in the gap 134, and the elastic biasing force of the repulsive coil spring 75 pivots the manipulation lever 16 backward counterclockwise in FIG. 6 about the pivot axis portion 81 as the fulcrum. Therefore, the first lock pawl 83 similarly pivots backward and returns to a position facing the eaves portion 129 of the third guided portion 123. As a result, the second and first engaging pawls 84 and 83 of the manipulation lever 16 prevent the second and third guided portions 122 and 123 of the shield 4 from suspending (that is, separating from the movable base member 14).

Figure 5:
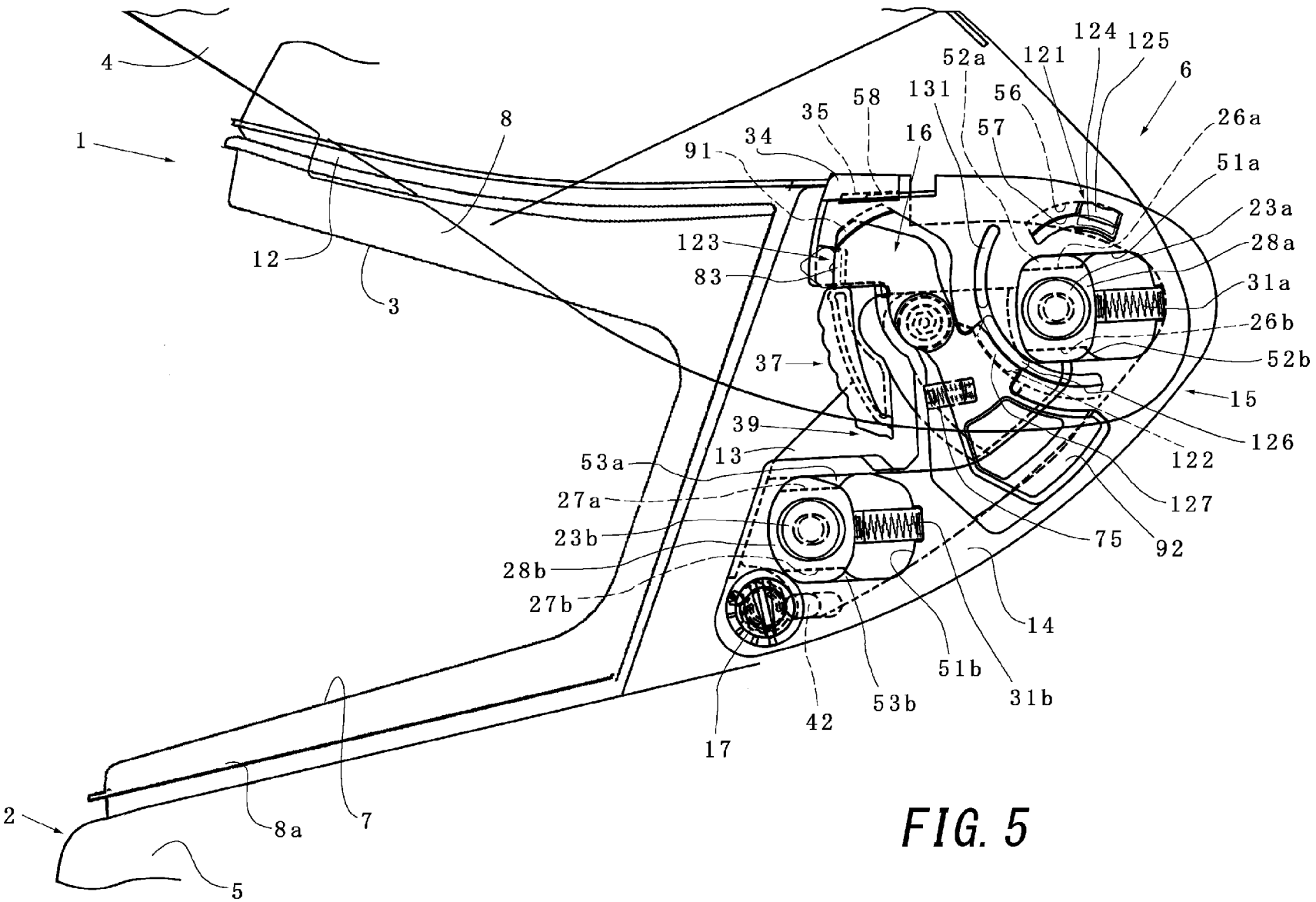
FIG. 5 is an enlarged left side view similar to FIG. 2, in which the shield is in a fully-open state.

In the above-described state, the shield 4 is in the fully-open state shown in FIG. 5. For this reason, the third guided portion 123 of the shield 4 exists in the gap 134 formed by the stationary base member 13 and the movable base member 14. In this state, the common central point C1 of the movable base member 14 and the common central point C2 of the shield 4 substantially match except that they are shifted in the direction of the thickness of the movable base member 14 or stationary base member 13.

The assembling operation described in the above items (a) to (e) can attach the shield attaching mechanism 6 to the head protecting body 2.

3. Operation of Shield Attaching Mechanism

Figure 3:
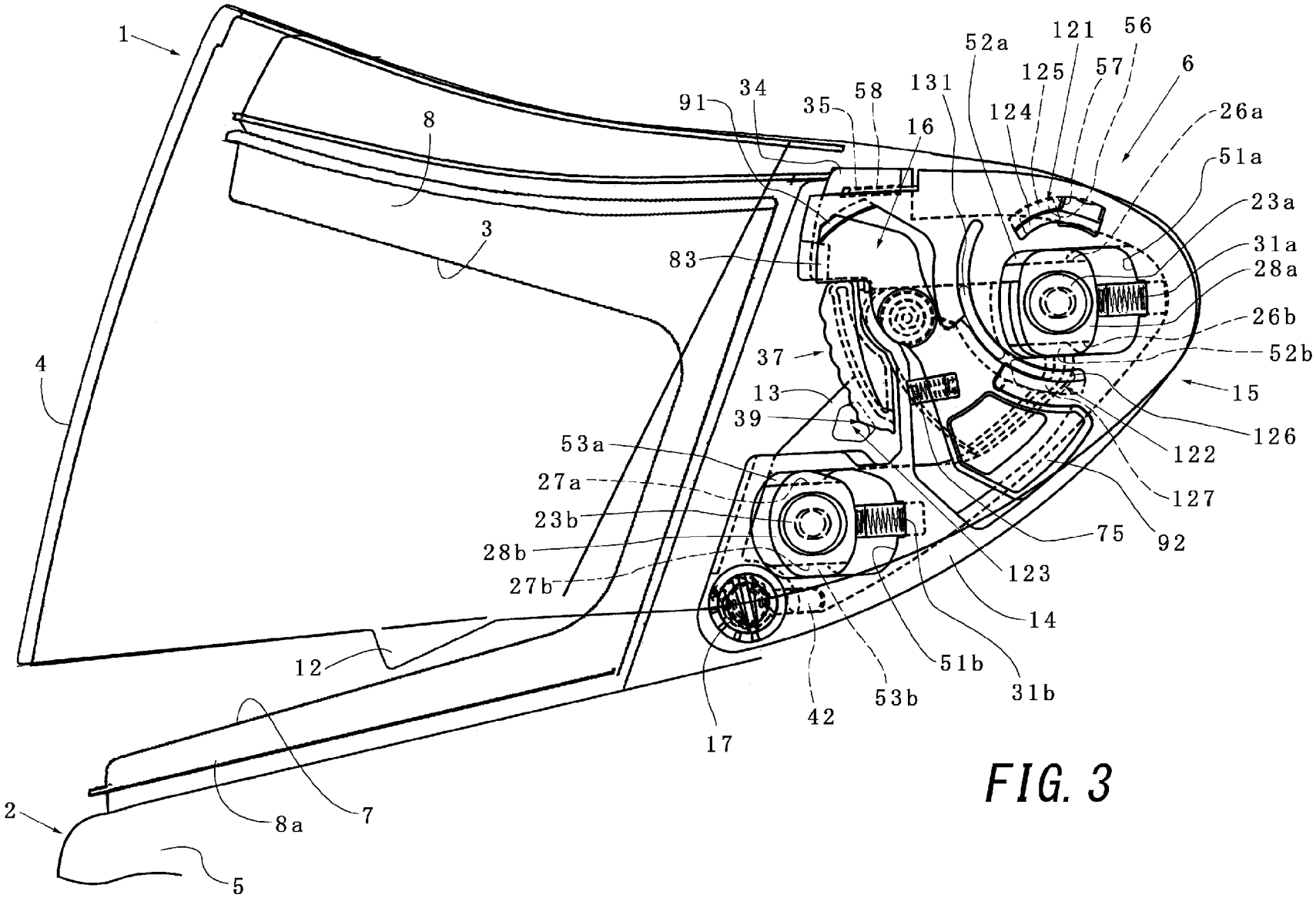
FIG. 3 is an enlarged left side view similar to FIG. 2, in which the shield is in a stage-1 open state.
Figure 4:
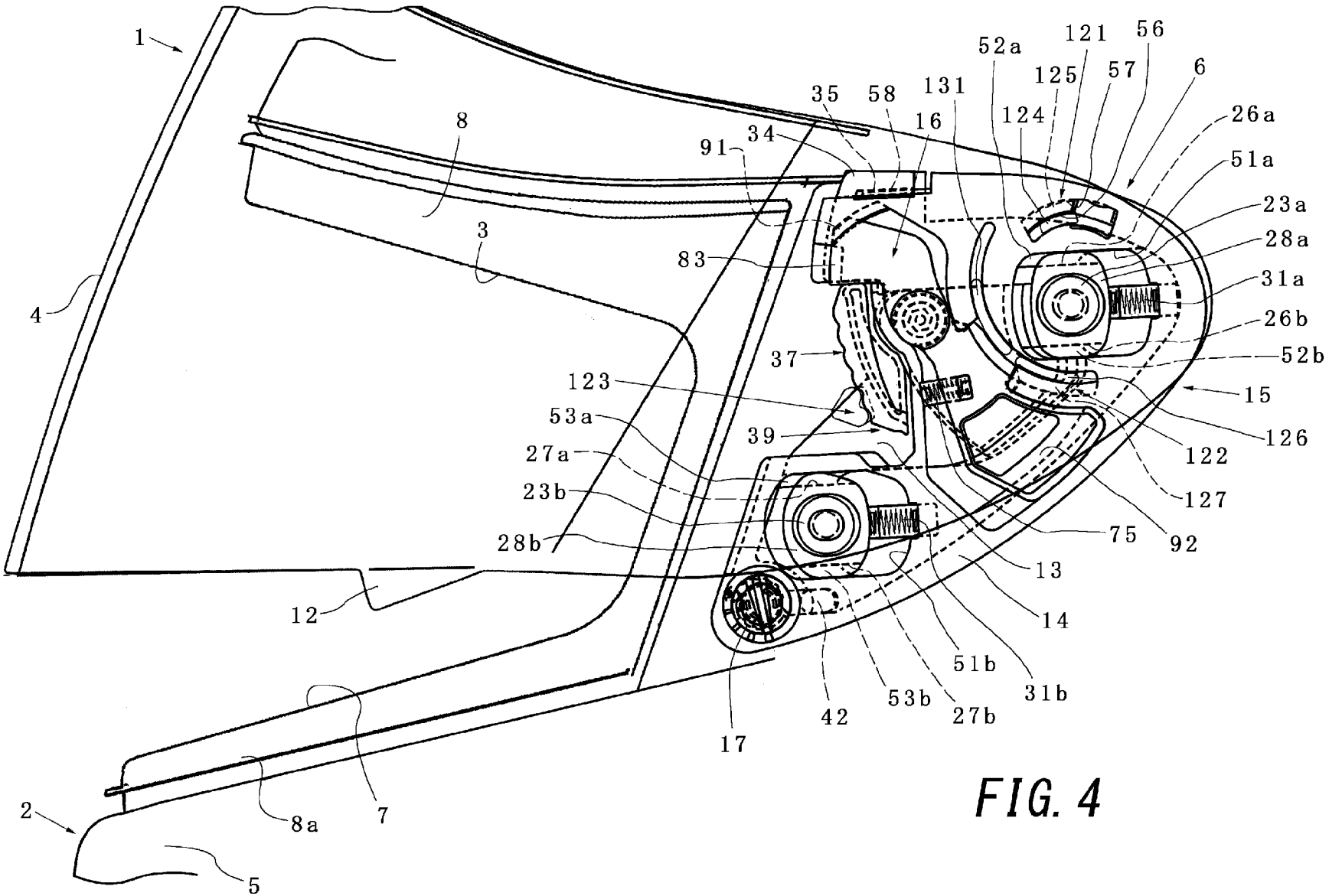
FIG. 4 is an enlarged left side view similar to FIG. 2, in which the shield is in a stage-2 open state.
Figure 7:
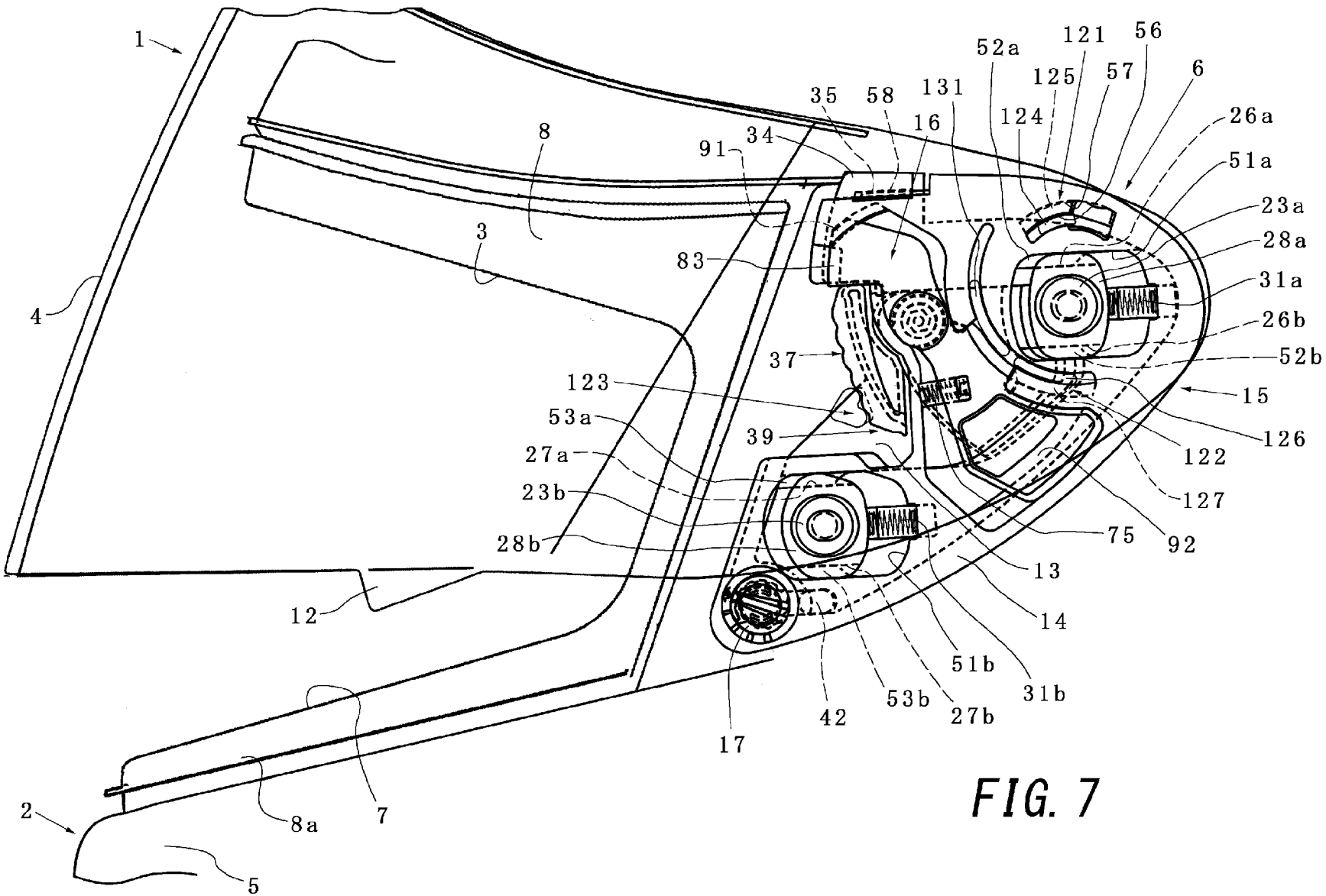
FIG. 7 is an enlarged left side view, similar to FIG. 4, of a state wherein a shield position adjustment operation button is pivoted forward.
Figure 8:
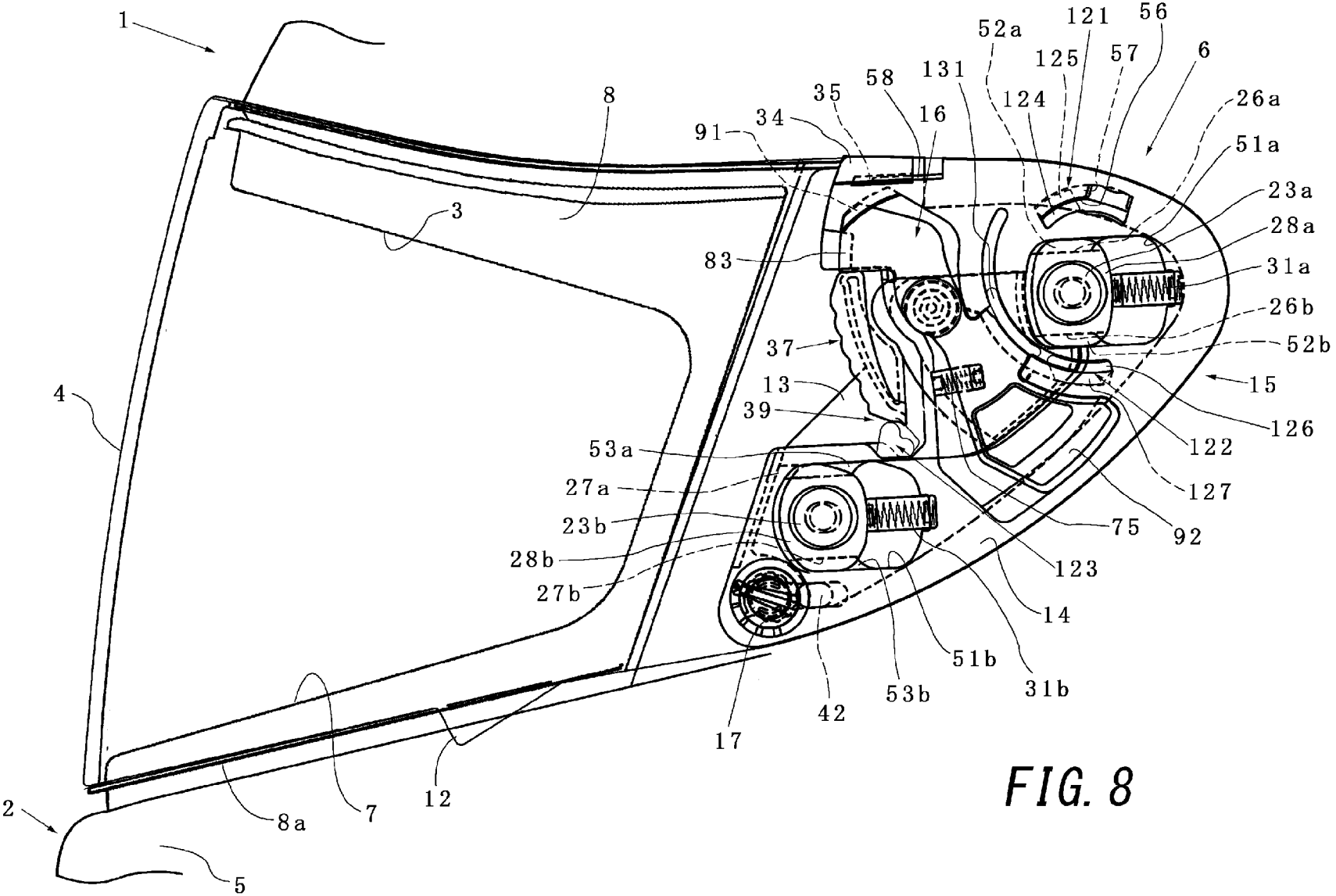
FIG. 8 is an enlarged left side view, similar to FIG. 2, of a state wherein the shield is changed for the state shown in FIG. 7 to a fully-closed state.

The shield 4 can employ at least the states described in the following items (a) to (g):

(a) fully-closed state shown in FIGS. 1 and 2,
(b) stage-1 open state shown in FIG. 3,
(c) stage-2 open state shown in FIG. 4,
(d) fully-open state shown in FIG. 5,
(e) removable state shown in FIG. 6,
(f) state shown in FIG. 7 during adjustment, and
(g) state shown in FIG. 8 after adjustment.

The operation of the shield attaching mechanism will be described below in "(1) fully-closed state", "(2) stage-1 open state", "(3) stage-2 open state", "(4) fully-open state", "(5) removable state", "(6) state during adjustment" and "(7) state after adjustment" with reference to FIGS. 1 to 20.

(1) Fully-Closed State

The shield 4 is in the fully-open state shown in FIG. 5 immediately after it attaches to the movable base member 14 as described in the above item 2(6). When sufficiently pivoting the shield 4 downward from above about the common central points C2 at its left and right ends as the pivot center by, for example, placing the fingers on the finger rest 12 of the shield 4, the shield 4 is set in the fully-closed state shown in FIG. 2. In the fully-closed state, the lower end of the shield 4 comes into contact with the projecting ridge 8*a* of the window opening rim member 8. Also, each of the first and second guided portions 121 and 122 of the shield 4 abuts against one terminal end of the corresponding one of the second and third guides 56 and 62 of the movable base member 14, or is set in a state immediately before abutting against it. The fourth guided portion 131 of the shield 4 is located in a region including the gap 135 (and a vicinity thereof) out of a moving path formed from the first and second guides 71 and 72 and the gap 135. The third guided portion 123 is located at a corner 136 of the movable base member 14. One tooth portion 132 out of the two tooth portions 132 and 133 of the base portion 128 of the third guided portion 123 engages with the stopper recess 38*a* of the stationary base member 13. Hence, since the third guided portion 123 is sandwiched between the movable base member 14 and the stationary base member 13, and its position is relatively firmly held, the left end of the shield 4 is attached to the head protecting body 2 in a substantially locked state by the shield attaching base member 15. Note that the operation of the shield attaching mechanism 6 from the fully-open state to the fully-closed state is substantially opposite to the operation from the fully-closed state to the fully-open state, and a detailed description will not be repeated here. In the fully-closed state shown in FIG. 2, the tooth portion 132 of the third guided portion 123 of the shield 4 relatively abuts against the stopper recess 38*a* of the high-level portion 36 of the stationary base member 13, or is located below the stopper recess 38*a* to be relatively close to it.

(2) Stage-1 Open State

In the fully-closed state shown in FIG. 2, when the shield 4 is slightly raised by, for example, placing fingers of the helmet wearer on the finger rest 12, it is set in the stage-1 open state shown in FIG. 3. When attaining the stage-1 open state, the shield 4 slightly pivots forward clockwise in FIG. 2 with respect to the movable base member 14 about the common central point C2 as the pivot center. Hence, the first, second and fourth guided portions 121, 122 and 131 of the shield 4 are guided by the second, third and fourth guide portions 56, 62 and 66 of the movable base member 14, respectively. At the same time, the third guided portion 123 of the shield 4 is also guided by the cam portion 38 and the click tooth portion 37 of the stationary base member 13. For this reason, the first to fourth guided portions 121 to 123 and 131 of the shield 4 pivot forward clockwise in FIG. 2 about the common central point C2 as the pivot center. Hence, the tooth portion 132 of the third guided portion 123 engages with the lowermost recess of the click tooth portion 37. In other words, the lowermost tooth portion of the click tooth portion 37 engages with the recess between the pair of tooth portions 132 and 133 of the third guided portion 123. As a result, the shield 4 is accurately held in the stage-1 open state shown in FIG. 3.

When the shield 4 in the fully-closed state shown in FIG. 2 changes to be set in the stage-1 open state shown in FIG. 3, the pair of tooth portions 132 and 133 of the third guided portion 123 of the shield 4 pivots clockwise, as it is pushed out substantially forward (that is, substantially to the left in FIG. 2) by the cam portion 38 of the stationary base member 13, to ride over the lowermost tooth portion of the click tooth portion 37. Note that this ride-over takes place when the movable base member 14 substantially linearly moves forward substantially to the front side, together with the shield 4, with respect to the stationary base member 13 against the elastic biasing forces of the repulsive coil springs 31*a* and 31*b*. Therefore, when the shield 4 moves upward to the stage-1 open state, the shield 4 (and accordingly the anti-fogging auxiliary shield attaching to its inner surface as needed) is pushed out to the front side by, for example, 3 mm. Hence, when the shield 4 changes to be set in the stage-1 open state, the shield 4 and anti-fogging auxiliary shield 10 attached as needed do not catch on the window opening rim member 8 (particularly its upper rim portion) to be unable to move upward smoothly. Note that for the ride-over, the shield 4 is moved substantially upward by fingers of the helmet wearer or the like which are placed on the finger rest 12. In this case, the second force oriented substantially forward is also applied to the shield 4, as described in section 1. It is therefore possible to smoothly raise the shield 4 to the stage-1 open state.

(3) Stage-2 Open State

In the stage-1 open state shown in FIG. 3, when further pulling up the shield 4 a little, it is set in the stage-2 open state shown in FIG. 4. Note that when setting the shield 4 in the stage-2 open state, it further pivots a little clockwise in FIG. 3 with respect to the movable base member 14 about the common central point C2 as the pivot center. Hence, the first, second and fourth guided portions 121, 122 and 131 of the shield 4 are further guided by the second, third and fourth guide portions 56, 62 and 66 of the movable base member 14, respectively. At the same time, the third guided portion 123 of the shield 4 is also further guided by the click tooth portion 37 of the stationary base member 13. Hence, the first to fourth guided portions 121 to 123 and 131 of the shield 4 pivot forward clockwise in FIG. 3 about the common central point C2 as the pivot center. As a result, the pair of tooth portions 132 and 133 of the third guided portion 123 engages with the recess immediately above the lowermost recess and the lowermost recess of the click tooth portion 37, respectively, as shown in FIG. 4. In other words, the tooth portion immediately above the lowermost tooth portion of the click tooth portion 37 engages with the recess between the pair of tooth portions 132 and 133 of the third guided portion 123. For this reason, the shield 4 is accurately held in the stage-2 open state shown in FIG. 4.

(4) Fully-Open State

In the stage-2 open state shown in FIG. 4, when further pulling up the shield 4 largely, it is set in the fully-open state (that is, maximal open state) shown in FIG. 5. Note that when shifting to the fully-open state, the shield 4 further pivots forward largely clockwise in FIG. 4 with respect to the movable base member 14 about the common central point C2 as the pivot center. The fully-open state shown in FIG. 5 is substantially the same as the state immediately after attaching the shield 4 to the head protecting body 2, which has been explained in the above item 2(6) concerning the operation described in item (e), and a detailed description thereof will be omitted. Note that in the fully-open state shown in FIG. 5, the third guided portion 123 of the shield 4 passes the click tooth portion 37 of the stationary base member 13 and is located above the click tooth portion 37. Hence, the common central point C2 as the pivot center of the shield 4 and anti-fogging auxiliary shield attached as needed is held at a position which is retracted to the most rear side between the stage-1 open state and the fully-open state. In the fully-open state, one of the stopper engaging recesses 104*a* to 104*e* of the pivotal manipulation button 17 attached to the movable base member 14 abuts against the stopper portion 42 of the stationary base member 13, thereby holding the position of the movable base member 14. When the shield 4 is pulled up from the stage-1 open state to the fully-open state, as described above, the shield 4 and anti-fogging auxiliary shield attached as needed can be prevented from projecting forward more than necessary from the head protecting body 2. It is therefore possible to prevent to some extent the shield 4 from flapping in wind during driving. Note that the position holding are done in the same way even in the fully-closed state described in the above item (1).

(5) Removable State

In the fully-open state shown in FIG. 5, when the shield attaching/removing manipulation lever 16 is pivoted forward clockwise in FIG. 5 about the pivot axis portion 81 as the fulcrum against the elastic biasing force of the repulsive coil spring 75, the shield 4 is set in the removable state shown in FIG. 6. Note that the removable state is substantially the same as the removable state at the time of a forward pivot operation of the shield attaching/removing manipulation lever 16 explained in the above item 2(6) concerning the operation described in item (e), and a detailed description thereof will be omitted. In the removable state shown in FIG. 6, by performing operation opposite to that explained in the above item 2(6) concerning the operation described in item (e), the left end of the shield 4 can be easily removed from the movable base member 14.

In the removable state shown in FIG. 6, as described in the above item (4), one of the stopper engaging recesses 104*a* to 104*e* of the pivotal manipulation button 17 attached to the movable base member 14 abuts against the stopper portion 42 of the stationary base member 13. For this reason, the movable base member 14 completely moves backward with respect to the stationary base member 13. Hence, during a period between a timing before the shield 4 is removed from the movable base member 14 and a timing after the removal, the elastic biasing forces of the repulsive coil springs 31*a* and 31*b* will not further move the movable base member 14 backward with respect to the stationary base member 13. This also applies during a period between a timing before the shield 4 is attached to the movable base member 14 and a timing after the attachment. Therefore, the shield 4 can be attached to and removed from the movable base member 14 easily and reliably.

(6) State during Adjustment

The position of the shield 4 with respect to the window opening rim member 8 substantially in the back-and-forth direction, in the fully-closed state shown in FIGS. 1, 2 and 8, can be adjusted by manipulating the pivotal manipulation button 17. Note that when performing this adjustment, the shield 4 needs to be set in one of the stage-2 open state and the stage-3 and subsequent open states except the fully-open state (that is, one of the stage-2 to stage-6 open states) in advance such that the helmet wearer or the like can manipulate the pivotal manipulation button 17. For example, the adjustment operation in the stage-2 open state shown in FIG. 7 will be described. The stopper portion 42 of the stationary base member 13 is separated from all of the stopper engaging recesses 104*a* to 104*e* of the pivotal manipulation button 17. Hence, when a screwdriver (not shown) or the like is engaged with the groove 101 of the pivotal manipulation button 17 and then pivoted, the positioning projection 114 changes its engaging state from one of the plurality of positioning recesses 103 to another. Note that the separate state also occurs in the stage-1 to stage-6 open states except the fully-closed state and the fully-open state.

(7) State after Adjustment

When the shield 4 is changed from the state during adjustment described in the above item (6) to the fully-closed state, the stopper portion 42 of the stationary base member 13 changes the engaging target from one of the stopper engaging recesses 104*a* to 104*e*, which engaged before the adjustment, to another. In this case, as for the positions of the stopper engaging recesses 104*a* to 104*e*, the distance from the pivot center C3 of the pivotal manipulation button 17 sequentially decreases by, for example, 0.25 mm. For this reason, the position of the pivotal manipulation button 17 (accordingly the movable base member 14) with respect to the stationary base member 13 substantially in the back-and-forth direction in the fully-closed state moves substantially forward or substantially backward by 0.25X mm (X is the number representing how far one of the stopper engaging recesses 104*a* to 104*e*, which engages after adjustment, is apart from another of the stopper engaging recesses 104*a* to 104*e*, which engaged before adjustment). Hence, with the above adjustment, the position of the shield 4 with respect to the head protecting body 2 substantially in the back-and-forth direction in the fully-closed state can be adjusted to a desired position within the range of 0.25X mm.

Having described a specific preferred embodiment of the present invention with reference to the accompanying drawings, it is to be understood that the invention is not limited to the precise embodiment, and that various changes and modifications may be effected therein by one skilled in the art without departing from the scope or spirit of the invention as defined in the appended claims.

For example, in the above-described embodiment, the present invention is applied to the full-face-type helmet 1. However, the present invention can also be applied to a full-face-type helmet serving also as a jet-type helmet in which the chin cover can move upward, a jet-type helmet, a semi-jet-type helmet, and the like.

In the above-described embodiment, the shield position adjustment operation member is formed from the shield position adjustment pivotal manipulation member 17. However, the shield position adjustment operation member 17 need not always be of a pivotal manipulation type. Various members such as a member to be manipulated substantially linearly forward and backward and a member to be manipulated forward and backward along an arbitrary curve may be used.

In the above-described embodiment, a stopper means having a single position holding portion (more specifically, stopper portion 42) that can comprise a plurality of position holding portions is provided on the stationary base member 13. In addition, a stopped means having a plurality of position holding portions (more specifically, stopper engaging recesses 104*a* to 104*e*) is provided on the movable base member 14. However, a stopped means having a single position holding portion that can comprise a plurality of position holding portions may be provided on the movable base member 14, and a stopper means having a plurality of position holding portions may be provided on the stationary base member 13. In this case as well, the stopper means 104*a* to 104*e* and the plurality of positioning recesses 103 can be provided on a common member such as the pivotal manipulation button 17.

The above-described embodiment employs the repulsive coil springs 31*a*, 31*b* and 75 as elastic biasing means or elastic biasing members. Alternatively, of the three elastic biasing means 31*a*, 31*b* and 75, one, two, or all three may comprise tension coil springs, or springs other than coil springs, for example, leaf springs.

In the above-described embodiment, the shield attaching/removing manipulation member 16 is formed from a manipulation lever capable of pivoting forward and backward. Alternatively, the manipulation member 16 can be formed from a member capable of linearly moving forward and backward, or a member capable of forward and backward movement other than forward and backward pivot or linear forward and backward movement.

The invention claimed is:

1. A helmet shield attaching mechanism comprising:

a shield attaching base member attaching to a head protecting body, and a shield whose region including one of a left end and a right end and a vicinity thereof rotatably attaches to said shield attaching base member, said shield attaching base member comprising a stationary base member attaching to said head protecting body, and a movable base member attaching to said stationary base member so as to be movable forward and backward substantially in a back-and-forth direction with respect to said stationary base member, and said shield being substantially rotatably supportable by said movable base member, wherein said stationary base member comprises stopper means, said movable base member comprises stopped means whose position is held by said stopper means in an at least substantially fully-closed state of said shield, and when a holding position of said stopped means whose position is held by said stopper means in the at least substantially fully-closed state of said shield is selected from one of a plurality of portions of said movable base member substantially in the back-and-forth direction, the holding position substantially in the back-and-forth direction of said shield with respect to said head protecting body in the at least substantially fully-closed state is selected, the helmet shield attaching mechanism further comprising:

elastic biasing means capable of elastically biasing said movable base member substantially backward to said stationary base member;

a shield position adjustment pivotal manipulation member attached to one of said movable base member and said stationary base member so as to be able to rotate;

rotation preventing means provided on the one of said movable base member and said stationary base member; and back-and-forth positioning means provided on the other of said movable base member and said stationary base member, said pivotal manipulation member comprising a plurality of first recess/projection engaging means configured to selectively engage with said back-and-forth positioning means, and a plurality of second recess/projection engaging means configured to selectively engage with said rotation preventing means, wherein when said back-and-forth positioning means selectively engages with one of said plurality of first recess/projection engaging means, the holding position substantially in the back-and-forth direction of said shield is selected, and when said rotation preventing means selectively engages with one of said plurality of second recess/projection engaging means, unwanted pivot of said pivotal manipulation member is prevented, wherein said shield position adjustment pivotal manipulation member comprises a pivotal manipulation button located between said head protecting body and said shield such that a whole outer surface of the pivotal manipulation button is covered by the shield when in the substantially fully-closed state, and wherein a cam face is provided on one of said stationary base member and said shield, a cam follower portion is provided on the other of said stationary base member and said shield, and when a force that substantially raises said shield in the substantially fully-closed state is applied to said shield, said cam follower portion relatively follows said cam face so that said shield also moves substantially forward.

2. A mechanism according to claim 1, wherein said movable base member is configured to be substantially linearly movable forward and backward substantially in the back-and-forth direction with respect to said stationary base member.

3. A mechanism according to claim 1, wherein in the at least substantially fully-closed state, said stationary base member is elastically biased by said elastic biasing means and held at a backward moving position so as to make said stopped means abut against said stopper means.

4. A mechanism according to claim 1, wherein said stopped means comprises a plurality of stopped means.

5. A mechanism according to claim 1, wherein the number of said stopped means is 3 to 7.

6. A mechanism according to claim 1, wherein the number of said stopped means is 4 to 6.

7. A mechanism according to claim 1, wherein the number of said plurality of second recess/projection engaging means is 3 to 7.

8. A mechanism according to claim 1, wherein the number of said plurality of second recess/projection engaging means is 4 to 6.

9. A mechanism according to claim 1, wherein positions of said stopped means are held by said stopper means only in the substantially fully-closed state and a substantially fully-open state of said shield.

10. A mechanism according to claim 1, wherein said shield comprises a finger rest provided in a region including a lower end and a vicinity thereof of at least one of a left portion and a right portion of said shield, said finger rest being inclined downward substantially from a rear side substantially to a front side.

11. A mechanism according to claim 1, wherein said cam face comprises a stopper recess configured to hold said shield at a substantially fully-closed position, an inclined surface configured to move said shield substantially forward, and a click tooth portion configured to hold said shield stepwise.

12. A mechanism according to claim 1, wherein a shield attaching/removing manipulation member manipulated to remove said shield from said movable base member is disposed on said movable base member so as to be movable forward and backward, and when said shield is rotated forward to the substantially fully-open state, and thereafter, said shield attaching/removing manipulation member is moved forward, a removable state of said shield is obtained.

* * * * *